US005797245A

United States Patent [19]

Murakami

[11] Patent Number: 5,797,245

[45] Date of Patent: Aug. 25, 1998

[54] DEVICE FOR AUTOMATICALLY RECEIVING AN UMBRELLA IN A BAG

[75] Inventor: Toshiyuki Murakami, Kanagawa, Japan

[73] Assignees: Kabushiki Kaisha Muraharu Seisakusho, Kanagawa; Niikura Scales Co., Ltd., Tokyo, both of Japan

[21] Appl. No.: 663,309

[22] PCT Filed: Jul. 19, 1995

[86] PCT No.: PCT/JP95/01433

§ 371 Date: Jun. 26, 1996

§ 102(e) Date: Jun. 26, 1996

[87] PCT Pub. No.: WO97/03882

PCT Pub. Date: Feb. 6, 1997

[51] Int. Cl.[6] ..... B65B 67/04; B65B 67/12; B65B 43/28; B65B 43/30

[52] U.S. Cl. ..... 53/572; 53/384.1; 53/390

[58] Field of Search ..... 53/572, 384.1, 53/390, 570, 260, 255

[56] References Cited

U.S. PATENT DOCUMENTS

| | | | |
|---|---|---|---|
| 3,673,767 | 7/1972 | Hutchinson | 53/572 X |
| 3,727,374 | 4/1973 | Williams | 53/572 |
| 4,250,694 | 2/1981 | Rochman | 53/572 |
| 5,442,898 | 8/1995 | Gabree et al. | 53/572 X |
| 5,551,219 | 9/1996 | Wei | 53/572 |

*Primary Examiner*—Horace M. Culver
*Attorney, Agent, or Firm*—Armstrong, Westerman, Hattori, McLeland & Naughton

[57] ABSTRACT

A bag storage device for automatically receiving wet umbrellas installed for example, in a bag storage device at the entrances of hotels, stores, buses, trains and the like for receiving a wet umbrella in a bag which is simply arranged and securely takes an umbrella in the receiving bag. The receiving bag is loaded in the main body of the device and an opening operation member for opening a receiving opening end of the receiving bag is arranged so that the insertion opening is opened by rotating the opening operation member with the point of the umbrella. The umbrella is automatically and easily taken into the bag without using a motor. Thus, the present invention can provide an extremely practical device which can be used where there is no electric power source as well as can reduce the manufacturing cost, without possibilities that an electric cord will become a hindrance and that an electric leak will occur.

3 Claims, 30 Drawing Sheets

DEVICE FOR AUTOMATICALLY RECEIVING AN UMBRELLA IN A BAG

FIELD OF THE INVENTION

The present invention relates to a device which is installed at the entrances of, for example, hotels, stores, and so on and automatically receives a wet umbrella in a bag in rainy weather.

BACKGROUND OF THE INVENTION

Conventionally, umbrellas have been put in receiving bags made of synthetic resin and so on in order to prevent clothes, floors, or commodities and so on from getting wet by wet umbrellas carried by customers in rainy weather at, for example, hotels, stores, and so on.

Various kinds of devices in which insertion openings of the receiving bags are automatically opened in order to easily conduct the operation of receiving umbrellas in the receiving bags and umbrellas are received only by inserting the umbrellas into the insertion openings which are opened have been proposed (refer to, for example, Japanese Patent Application Laid-open No. Sh. 60-134817 Official Gazette, Japanese Utility Model Application Laid-open No. Sh. 62-125708 Official Gazette, and Japanese Patent Application Laid-open No. Hei. 4-31222 Official Gazette).

However, the conventional devices use a means to suck with negative pressure a number of link and cam mechanisms and so on as means to open the insertion openings of the receiving bags, so that they are complicatedly arranged and have to use a vacuum suction pump, or a motor and so on; therefore the manufacturing cost increases and the devices can not be used where there is no electric power source nearby. In addition, there are disadvantages, for example, that the electric cords become a hindrance and that there is fear of an electric leak since the devices are used in rainy weather.

The present invention is proposed, mitigating the above-described disadvantages, and an object of the present invention is to provide a device which is simply arranged and can surely receive an umbrella in a bag and an umbrella receiving bag which is suitable for the device.

SUMMARY OF THE INVENTION

In order to attain the above-described objects, a device for receiving an umbrella of the present invention, where an umbrella receiving bag is loaded within a main body and an opening operation member which opens an insertion opening of the receiving bag is provided within the main body so as to be rotatable, is arranged so that an insertion opening of the above-described receiving bag is opened by rotating the opening operation member with a point of the umbrella.

There, the above-described opening operation member is desired to be supported so as to be movable by a mobile plate provided so as to advance to and retreat from the umbrella receiving bag loaded within the main body. The above-described opening operation member is desired to have a four node link mechanism consisting of the above-described movable plate, a pair of parallel links, and a fixing plate.

On embodying the present invention, the above-described opening operation member is desired to include a first member which has a receiving part to which the point portion of the umbrella abuts and is supported by a shaft so as to be free to rotate towards the main body, a second member which is supported by the shaft so as to be able to rotate towards the first member and is entirely formed to be a spatula form, and an elasticity member which is attached in the part where the above-described first member and second member are supported by the shaft and gives momentum to the second member to move upwards or in the direction where the second member abuts to the above-described receiving bag. There, a so-called "return spring" is desired to be used as the elasticity member, and its repulsion force is set to be greater than the gravity of the above-described second member, but only strong enough that no rolling of the receiving bag takes place.

Or, the above-described opening operation member is desired to include a fragmentary member which arranges a receiving part to which the point portion of the umbrella abuts, opens the insertion opening of the receiving bag, and guides the point portion of the above-described umbrella to the insertion opening which is opened, a first link which is positioned slantingly to the horizontal surface and arranges a rotation shaft of the above-described fragmentary member, a second link which has the first link fixed to its front end portion and rotates within the vertical surface, a first elasticity means which gives momentum to the above-described fragmentary member in the direction in which the fragmentary member returns to its position before it rotated around the first link, and a second elasticity means which gives momentum to the above-described second link to move to the receiving bag side. ***There, the repulsion force of the first elasticity means is set so that it is only strong enough that no rolling of the receiving bag takes place.

The present invention arranged as described above is provided with the opening operation member for opening the insertion opening of the receiving bag loaded within the main body so as to be movable within the main body, and is arranged so that the insertion opening of the receiving bag is opened by rotating the opening operation member with the point portion of an umbrella; therefore the receiving bag is easily and surely opened, and an umbrella can be automatically received in the bag.

In the present invention, when the above-described opening operation member is arranged so as to include the first member having the receiving part to which the point portion of an umbrella abuts, the second member which is supported by the shaft so as to be able to rotate towards the first member and is entirely formed to be a spatula form, and the elasticity member which is attached in the part in which the above-described first member and second member are supported by the shaft and gives momentum to the second member to move upwards or in the direction in which the second member abuts to the above-described receiving bag, the second member of a spatula form opens the insertion opening of the receiving bag when the point portion of the umbrella compresses the receiving part, and the point portion of the umbrella is guided into the receiving bag by the receiving part and the second member. When the opening operation member is arranged like this, the number of the parts, especially the number of rotation shafts can be reduced; therefore the possibilities of problems occurring are greatly reduced. Though the repulsion force of the above-described elasticity member is more than the gravity of the above-described second member, it is set so that it is only strong enough that no rolling of the receiving bag takes place; therefore the second member does not roll up the receiving bag when the second member returns to its original position.

Further, in the present invention, when the device is arranged so as to include the fragmentary member which arranges the receiving part to which the point portion of an umbrella abuts, opens the insertion opening of the receiving bag, and guides the point portion of the above-described umbrella to the insertion opening which is opened, the first link which is positioned slantingly to the horizontal surface and arranges the rotation shaft of the above-described fragmentary member, the second link which has the first link fixed to its front end portion and rotates within the vertical surface, the first elasticity means which gives momentum to the above-described fragmentary member in the direction in which the fragmentary member returns to its position before it rotated around the first link, and the second elasticity means which gives momentum to the above-described second link to move to the receiving bag side, the fragmentary part rotates downwards within the vertical surface with the first link, as the fragmentary part rotates around the first link when the point portion of the umbrella compresses the fragmentary member. As a result, in the state that the fragmentary part is inclined, the front end portion of the fragmentary part enters the inside of the insertion opening of the receiving bag and opens it. Then, the point portion of the umbrella is guided by the fragmentary member and enters the inside of the receiving bag through the insertion opening which is opened. After the umbrella is received in the receiving bag, though the fragmentary member returns to its original position by the first elasticity means, the repulsion force of the first elasticity means is only strong enough that no rolling of the receiving bag takes place, so that the receiving bag is prevented from being rolled up.

BRIEF DESCRIPTION OF THE DRAWINGS

The drawings attached in order to describe the contents of the present invention clearly are as follows.

DESCRIPTION OF THE PREFERRED EMBODIMENT(S)

A preferred embodiment of the present invention will be concretely described below with reference to the drawings.

Figure 1:
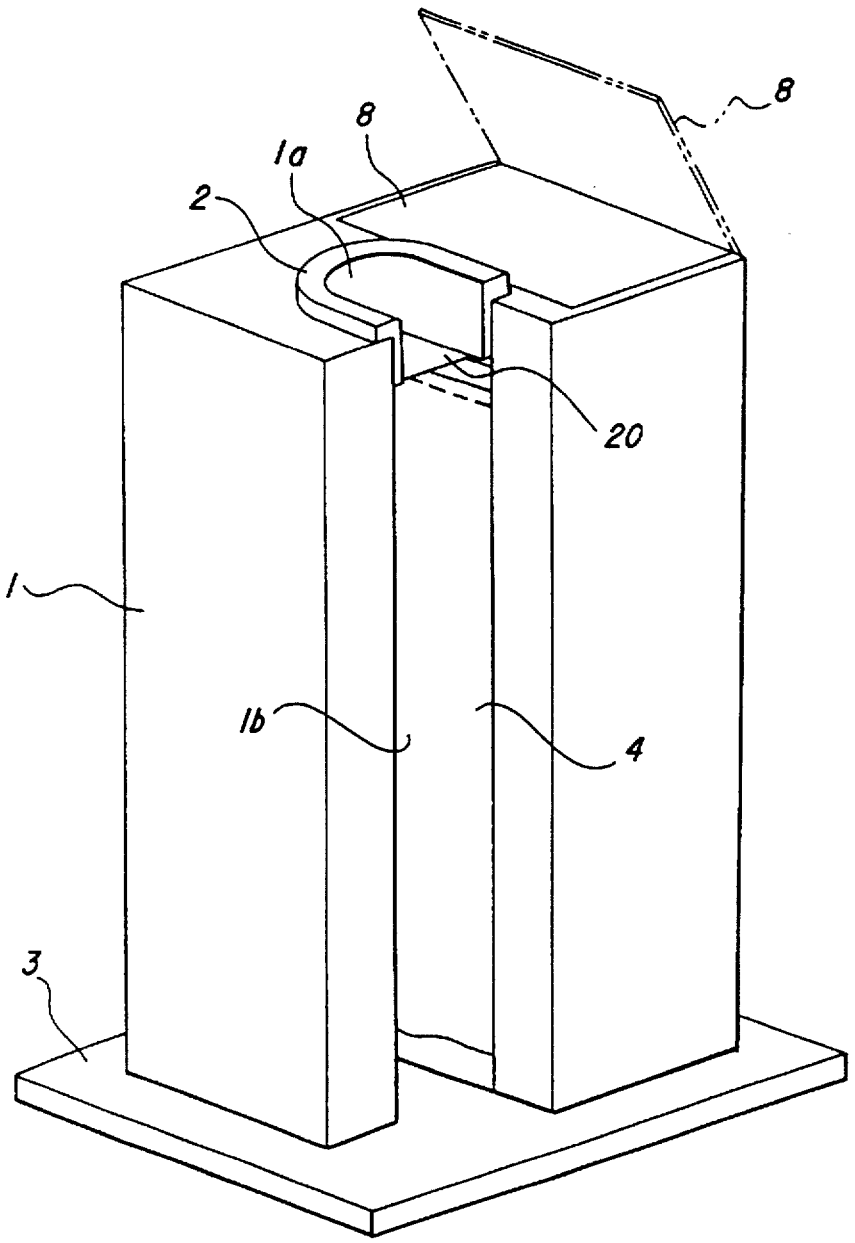
FIG. 1 is a perspective view of one embodiment of a device for automatically receiving an umbrella in a bag of the present invention.
Figure 2:
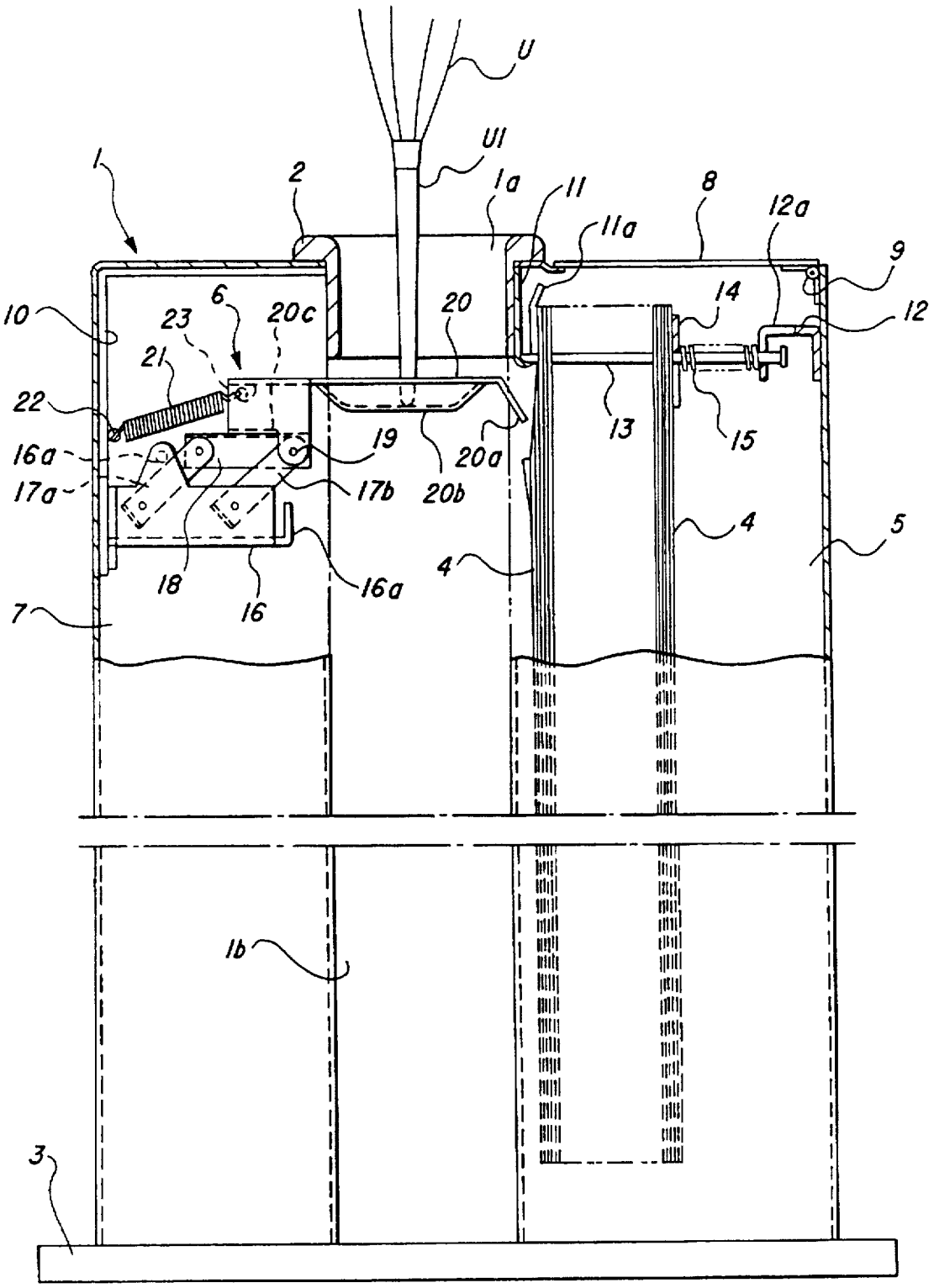
FIG. 2 is an enlarged vertical sectional front view of the embodiment in FIG. 1.
Figure 3:
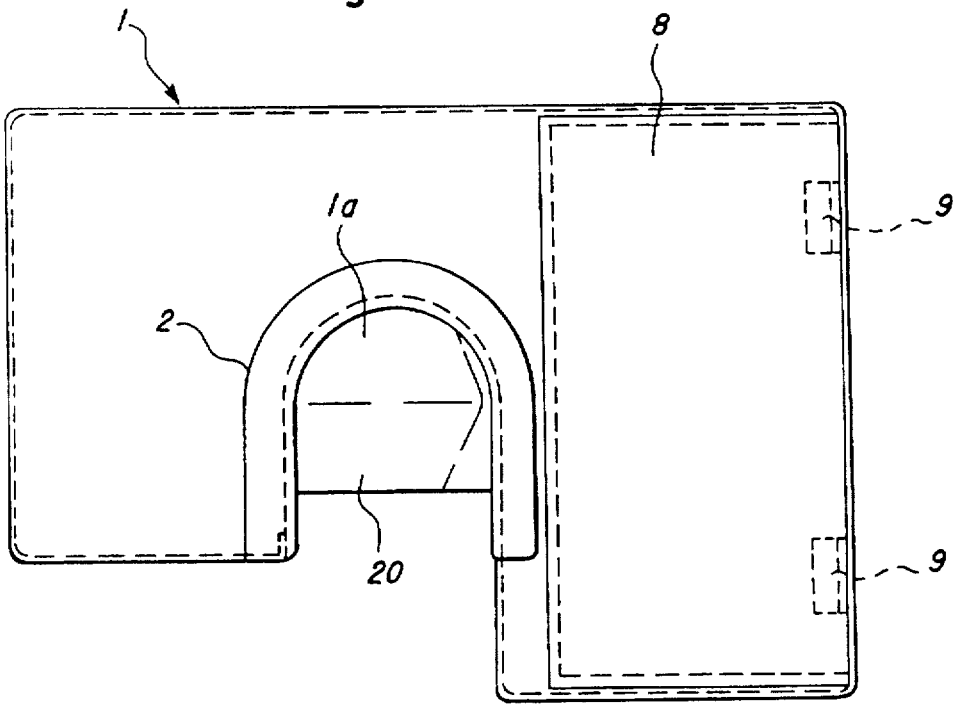
FIG. 3 is an enlarged plan view of the embodiment in FIG. 1 and FIG. 2.

FIG. 1 is a perspective view illustrating a preferable embodiment of a device for automatically receiving an umbrella in a bag of the present invention. FIG. 2 is an enlarged vertical sectional front view of the embodiment, FIG. 3 is a plan view of the embodiment, and FIG. 4 is a transverse cross section plan view of the embodiment.

Mark 1 is a main body of a device formed to be a virtual box form which is vertically long, and on top of the main body 1, an opening 1*a* which is a virtually U-shaped plane form is provided, with an edge frame 2 being provided at an edge portion of the opening. An opening 1*b* is provided in a center part of a front of the main body 1 of the device and is connected to the above-described opening 1*a*, and at the lower end of the main body 1, a pedestal 3 is provided as part of the main body.

Figure 4:
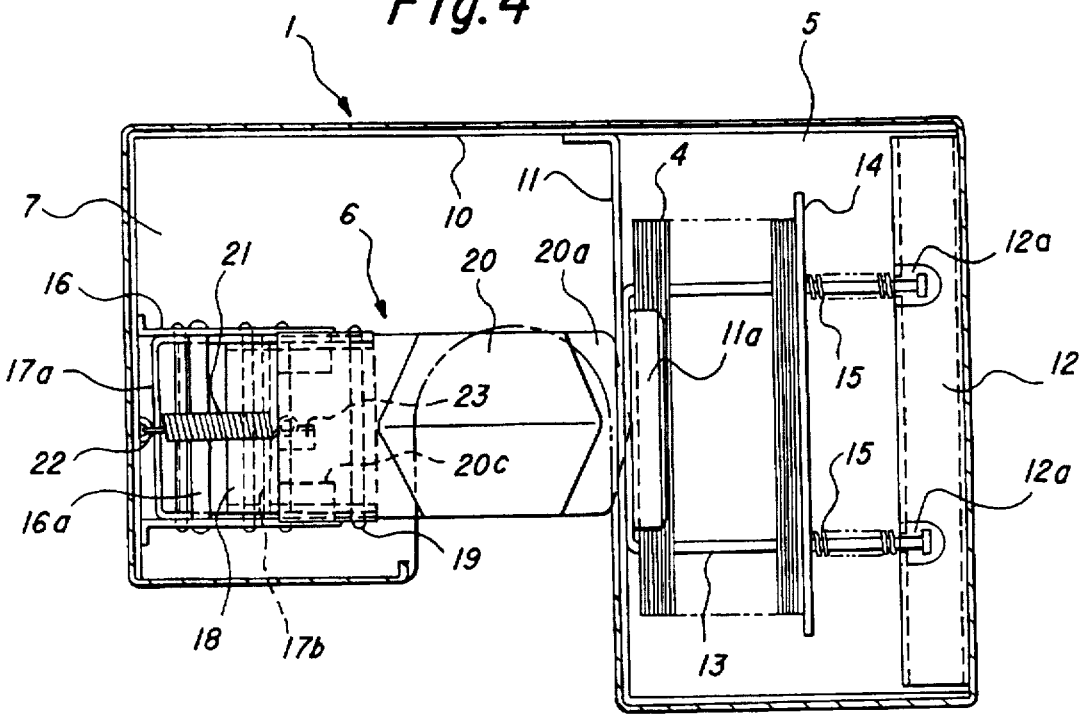
FIG. 4 is an enlarged transverse cross section plan view of the embodiment in FIG. 1 to FIG. 3.

Within the main body 1, as FIG. 2 and FIG. 4 illustrate, a bag holding case which holds an umbrella receiving bag 4, and a mechanism holding case 7 which holds an opening operation mechanism 6 for opening an insertion opening of the receiving bag 4 held in the bag holding case 5 are provided, and on a top surface of the bag holding case 5, an opening and closing motion lid 8 for holding the receiving bag 4 is provided so as to be able to be opened and closed by a hinge 9.

A fixing support board 10 is attached on an inner surface of an upper part of the main body 1, along both the above-described bag holding case 5 and a mechanism holding case 7, and a support plate 11 is attached on the bag holding case 5 side of the fixing support board 10. A hook 11*a* is provided at the support plate 11 as part of the support plate and at the hook 11*a* and an engagement member 12 which is attached on the inner surface of the upper part of the main body 1, facing the hook 11*a*, a hanger 13 of a virtually U-shaped plane form for hanging and holding the receiving bag 4 is provided so as to be freely detachable and attachable.

Figure 5:
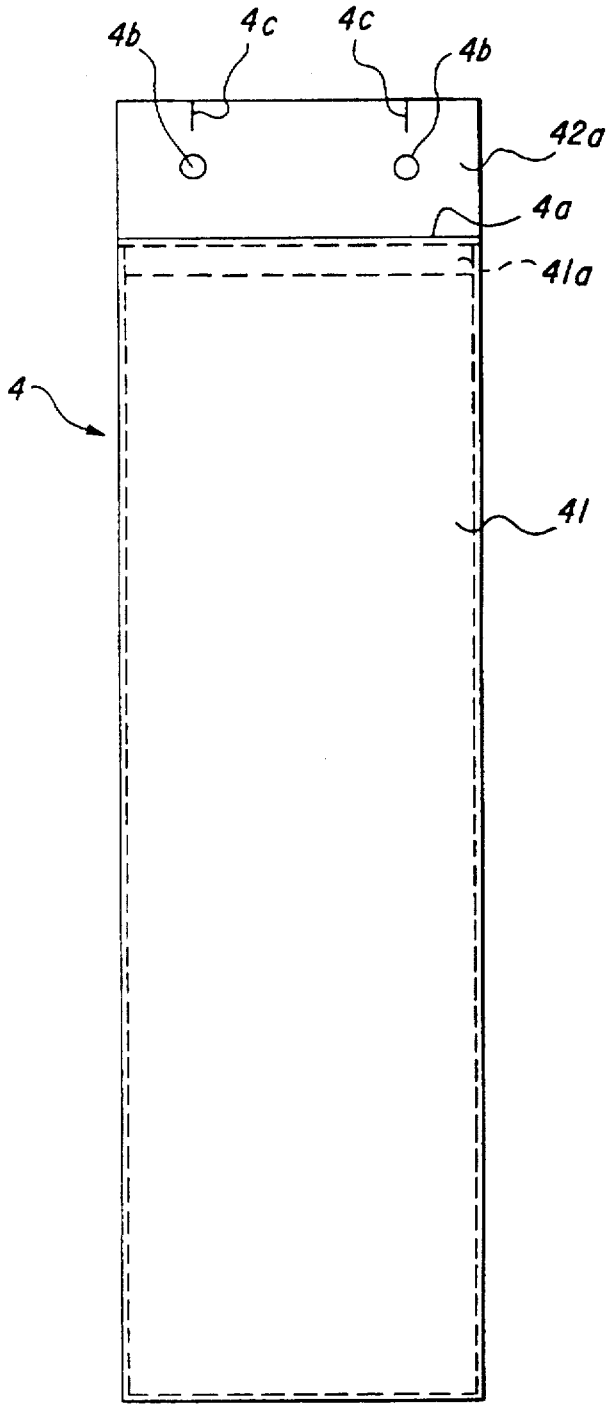
FIG. 5 is a front view of the receiving bag.
Figure 6:
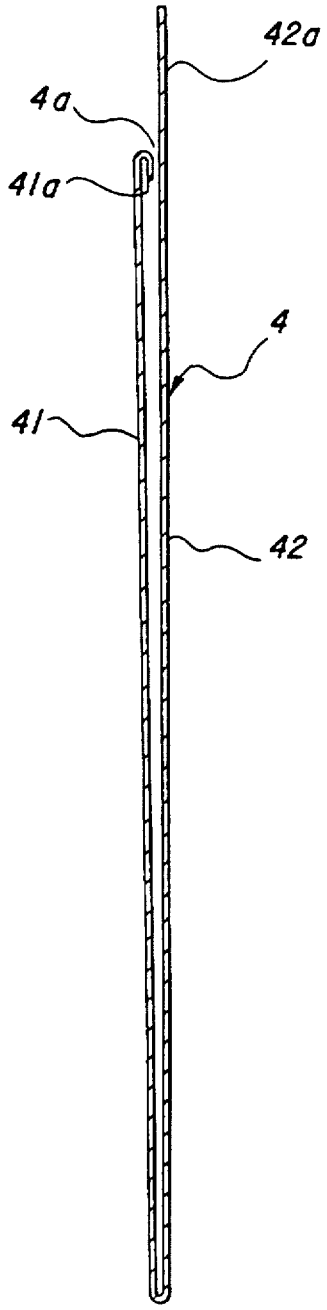
FIG. 6 is a sectional view of the receiving bag.

In the present embodiment, the above-described receiving bag 4 is made of a synthetic resin film and so on, and is formed to be an envelop form having an insertion opening 4*a* at an upper part, as FIG. 5 and FIG. 6 illustrate, and an upper end portion 41*a* of a front piece 41 in the insertion opening 4*a* is folded back in a U-shaped form. In the case of these drawings, the upper end portion 41*a* is folded towards the back side, that is to say, towards a back piece 42, however, the upper portion 41*a* may be folded forward to the front side, that is, towards the side opposite to the back piece 42. An upper end portion 42*a* of the back piece 42 projects to a position higher than the front piece 41, and at the projection part, a pair of hanger holes 4*b* are provided. By inserting the above-described U-shaped hanger 13 through each of the hanger holes 4*b*, and engaging the U-shaped hanger 13 in the above-described hook 11*a* and an engagement hole 12*a* formed at the above-described engagement member 12, a large number of receiving bags 4 are hung and held.

At the back side of the large number of receiving bags 4 which are hung and held, a compression plate 14 is provided along the hanger 13 so as to be movable, a compression coiled spring 15 is provided between the compression plate 14 and the above-described engagement member 12. The compression coiled spring 15 is held by being inserted through by the above-described hanger 13, and the compression spring 15 always gives momentum to the receiving bag 4 to move in the left direction of FIG. 2 by pressing the above-described compression plate 14 to contact the back of the receiving bag 4.

Meanwhile, within the above-described mechanism holding case 7, the opening operation mechanism 6 for opening the insertion opening 4*a* of the receiving bag 4 is held and positioned as described above and includes a fixing plate 16 provided at the above-described fixing support board 10 as a part of it, a movable plate 18 provided at the fixing plate 16 so as to be able to advance to or retreat from the above-described receiving bag 4 by a pair of U-shaped parallel links 17*a* and 17*b*, and an opening operation member 20 of a plate form provided on the movable plate 18 by a support shaft 19 so as to be rotatable. In the embodiment illustrated in the drawings, the support shaft 19 is also used as a connection shaft of one parallel link 17*b* to the movable plate 18, however, each of the support shaft and the connection shaft may be provided separately.

A front end portion 20*a* of the above-described opening operation member is formed to be a virtual triangle plane form and to bend downwards, and on the top of the center part of the opening operation member 20, a concave part 20*b* to which a ferrule U1 of a point of an umbrella U abuts. At both side parts opposite to the front end portion 20*a* of the above-described opening operation member 20, a folded part 20*c* of a form of U facing inward is formed, and a bottom surface of the folded part 20*c* is arranged to abut to a top surface of the movable plate 18. 21 in the drawings is a rotational return spring of the opening operation member 20 formed by a tension coiled spring, and both end parts of the return spring 21 are connected to and held by spring bearings 22 and 23 which are respectively provided at the opening operation member 20 and the above-described fixing support board 10. 16*a* and 16*b* are stoppers to which the above-described parallel links 17*a* and 17*b* abut, regulating the range in which the movable plate 18 moves and vibrates.

In the above-described arrangement, the receiving bag 4 for taking in umbrella is hung from and held by the hanger 13 as FIG. 2 illustrates, and is always given momentum to move in the left direction of FIG. 2 by the compression coiled spring 15 with the compression plate 14 between them. The opening operation member 20 and the movable plate 18 are always pulled to the left of FIG. 2 by the return spring 21, and are in the state illustrated in the drawing, with one link 17*a* abutting to the stopper 16*a*.

Figure 7:
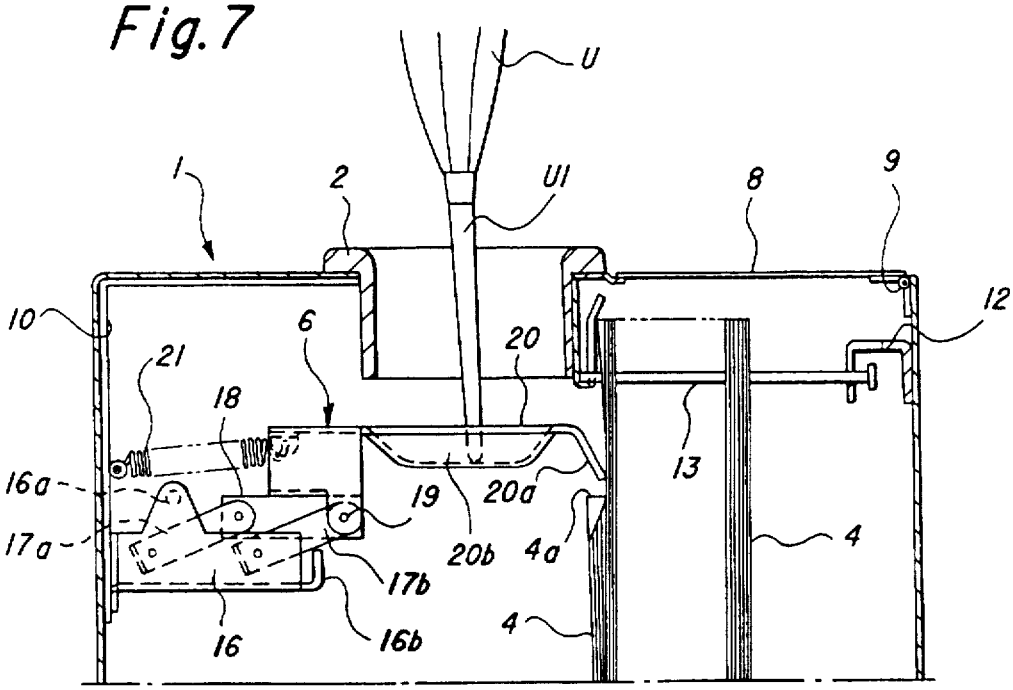
FIG. 7 is an operational diagram when an umbrella is received in the receiving bag.

In order to put the umbrella U into the receiving bag 4 in this state, insert a point portion of the umbrella U into the main body 1 through the opening 1*a* of a U-shaped form on the top of the main body 1 of the device, as FIG. 2 illustrates, make the ferrule U1 at the point portion abut to the top of the concave part 20*b* of the opening operation member 20 and press the umbrella U downwards. Then, as FIG. 7 illustrates, the opening operation member 20 as well as the movable plate 18 moves in the right direction of FIG. 7 against the return spring 21, and the movable plate 18 is prevented from moving with the link 17*b* in the right of FIG. 7 abutting to the stopper 16*b*, so that the front end portion 20*a* abuts to the upper portion of the back piece of the receiving bag 4 which is in the foremost position.

Figure 8:
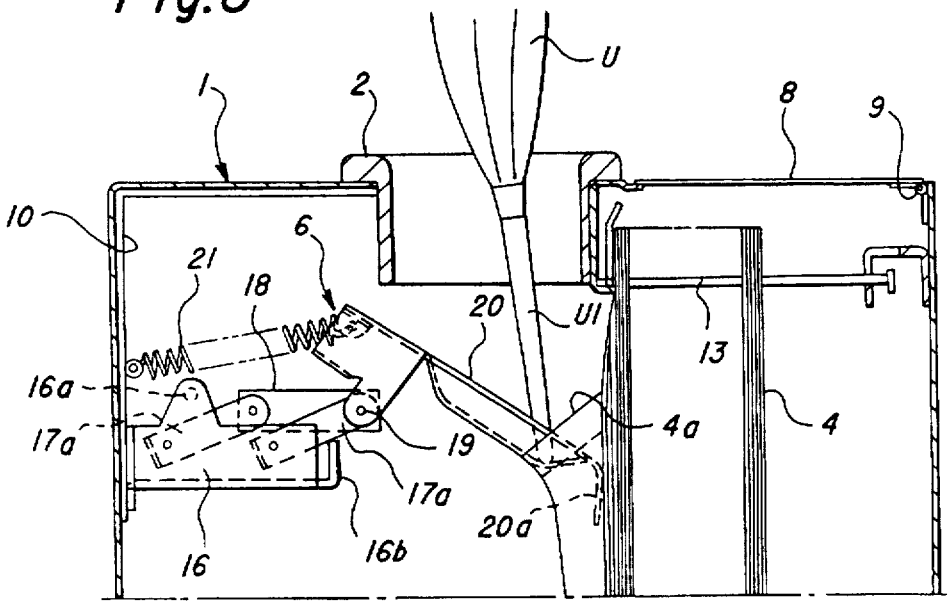
FIG. 8 is an operational diagram when an umbrella is received in the receiving bag.
Figure 9:
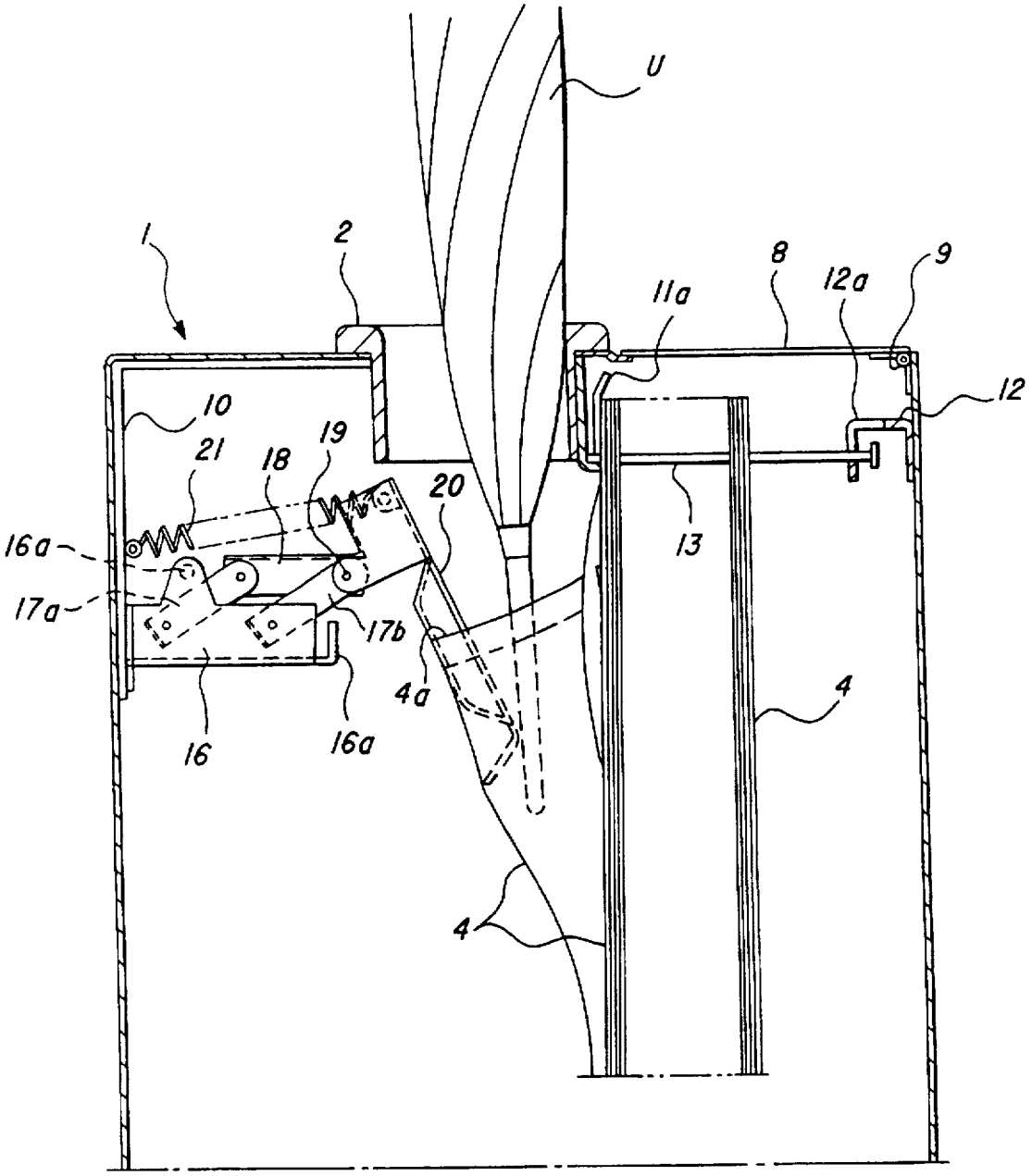
FIG. 9 is an operational diagram when an umbrella is received in the receiving bag.

When the umbrella U is further pressed downwards, the opening operation member 20 rotates around the support shaft 19 in the clockwise direction of FIG. 8, against the tension coiled spring 21, and the front end portion 20*a* of the opening operation member 20 advances into the insertion opening 4*a* of the above-described receiving bag 4, as FIG. 8 illustrates. When the umbrella U is further pressed downwards, the front end portion 20*a* of the opening operation member 20 advances further into the insertion opening 4*a*, as FIG. 9 illustrates, and at the same time the opening operation member 20 inclines further downwards, so that the ferrule U1 of the umbrella U which is made to abut to the top of the concave part 20*b* of the opening operation member 20 slides on the surface of the concave part 20*b* and enters the inside of the receiving bag 4.

Figure 10:
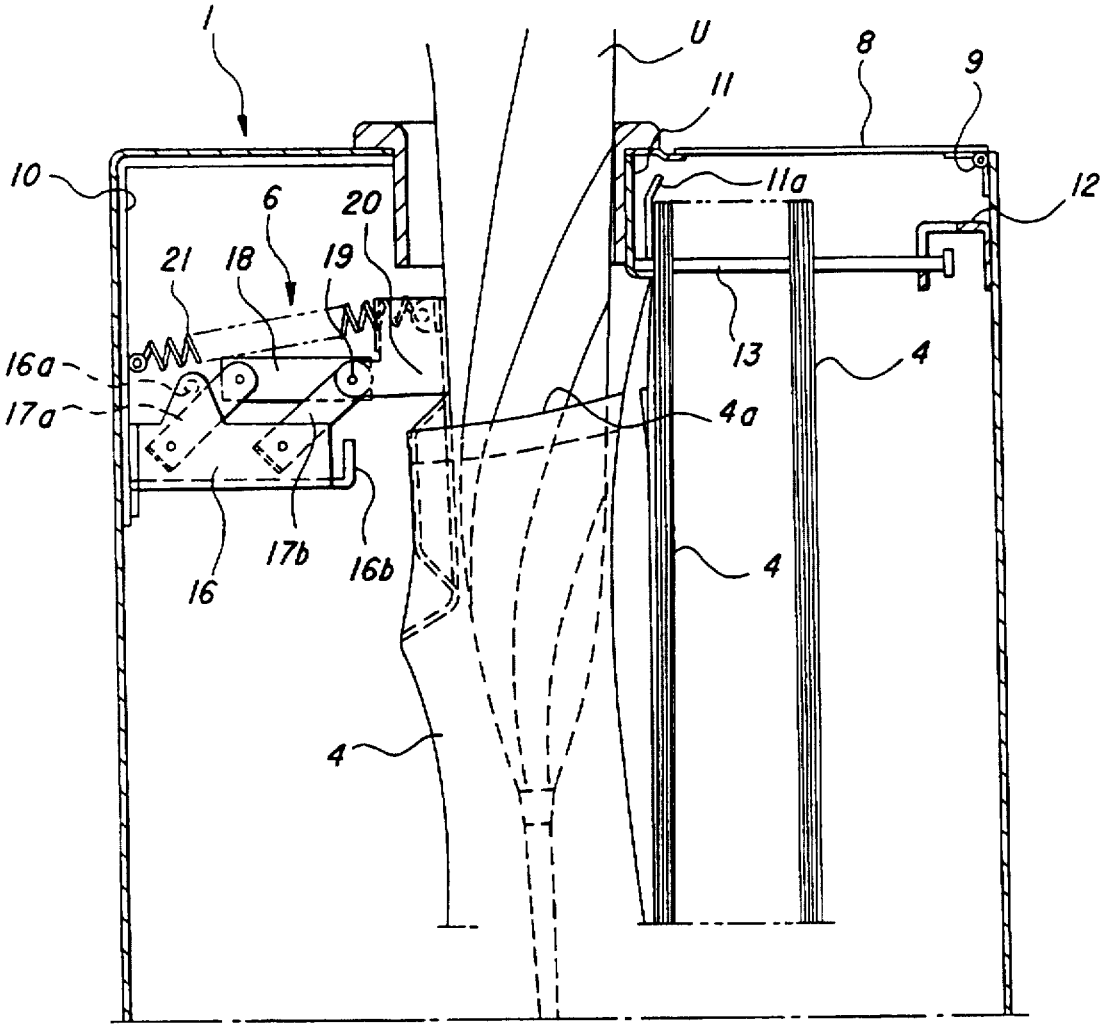
FIG. 10 is an operational diagram when an umbrella is received in the receiving bag.

By pressing the umbrella U further downwards, the umbrella U is automatically taken in the bag 4 as FIG. 10 illustrates, and the bag 4 which has received the umbrella U as well as the umbrella U is easily taken out, since an upper part of the hanger holes 4*b* are torn off and removed from the hanger 13 by pulling out the bag 4 which has received the umbrella U therein in the direction towards the front of the main body 1 of the device, making the umbrella U slant slightly downwards.

By taking out the umbrella U which has been received in the bag 4, the opening operation member 20 and the movable plate 18 automatically return to its original state illustrated in FIG. 2 by the tension coiled spring 21 to be in the standby state.

If the movable plate 18 is provided within the main body 1 of the device so as to be able to advance to or retreat from the receiving bag 4 loaded in the main body 1, and the opening operation member 20 is supported by the movable plate 18 so as to be rotatable as in the above-described embodiment, when the opening operation member 20 returns to the original state as described above, the movable plate 18 pulled in the left direction of FIG. 10 by the tension coiled spring 21 and the opening operation member 20 also moves in the left direction, before the opening operation member 20 rotates around the support shall 19 in the upward direction and returns to a virtually horizontal state, so that the opening operation member 20 returns to the original state without touching the receiving bag which is waiting for the next time it is used; therefore the opening operation member 20 is prevented from rolling up the next receiving bag.

Though, in the above-described embodiment, a pair of parallel links 17*a* and 17*b* are used as the means to support the movable plate 18 so as to be able to advance to and retreat from the receiving bag 4 loaded in the main body 1 of the device, other means may be selected and used appropriately without being limited to the above, and the insertion opening of the receiving bag may be opened only by the rotating movement of the opening operation member 20 by only providing the opening operation member 20 within the main body 1 of the device so as to be rotatable, without providing the above-described movable plate 18.

Next, other embodiments of the present invention are described.

Figure 11:
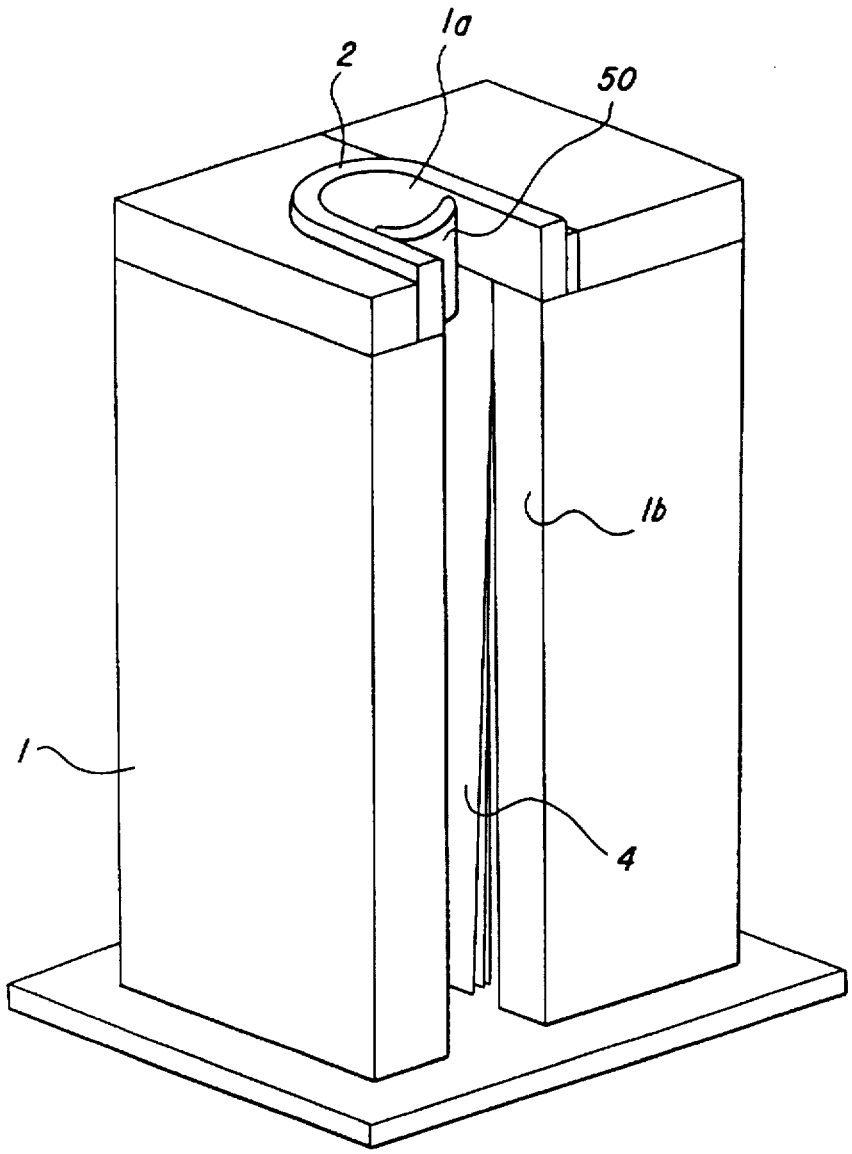
FIG. 11 is a perspective view of another embodiment of the device for automatically receiving an umbrella in a bag of the present invention.

Mark 1 is the main body of the device formed to be a virtual box form which is vertically long, and a number of bags 4 for receiving umbrellas are contained therein. The arrangement illustrated in FIG. 11 is virtually the same as that of the embodiment illustrated in FIG. 1 to FIG. 10 except for an opening and closing motion member expressed by a mark 50,, therefore the repeated description is abbreviated.

Figure 12:
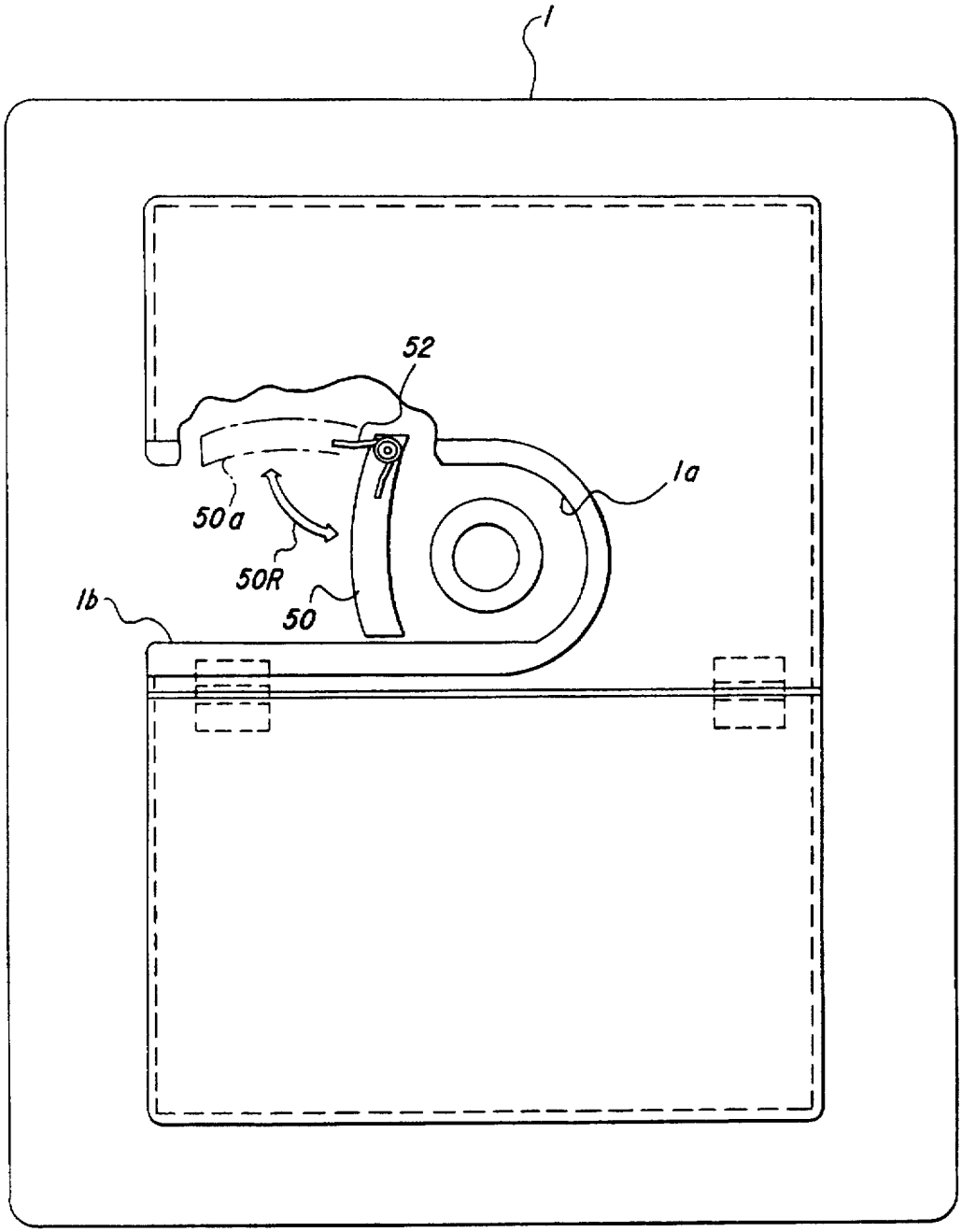
FIG. 12 is a plan view of the embodiment of FIG. 11.

The opening and closing motion member 50 Is also Illustrated in FIG. 12. In FIG. 11 and FIG. 12, the opening and closing motion member 50 is provided in proximity to a top portion of the main body 1 of the device, and rotates between the position illustrated by a solid line and the position 50*a* illustrated by a dashed line in FIG. 12 as an arrow 50R illustrates. A spring 52 is provided to return the opening and closing motion member 50 to the position illustrated by a solid line when the opening and closing motion member 50 is at the position 50*a*.

Figure 13:
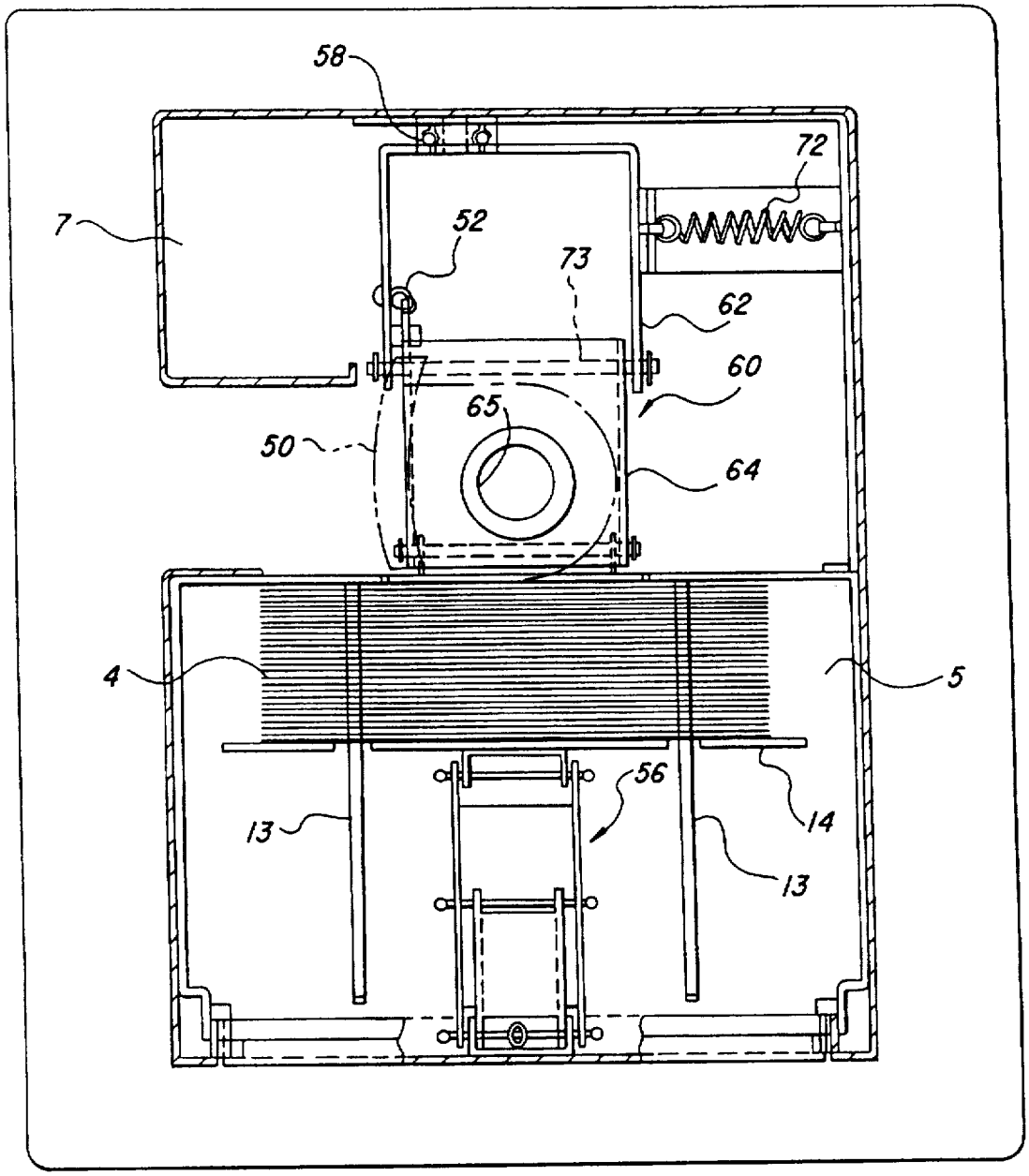
FIG. 13 is an enlarged transverse cross sectional view of the embodiment of FIG. 11 and FIG. 12.

FIG. 13 illustrates the arrangement of the lower part of the opening and closing motion member 50. As FIG. 13 illustrates, the bag holding case 5 which holds the umbrella receiving bags 4, and the mechanism holding case 7 which holds an opening operation mechanism 60 for opening the insertion opening of the receiving bags 4 which are held within the bag holding case 5 are provided within the main body 1 of the device.

The above-described receiving bag 4 is the same as that used in the embodiment illustrated in FIG. 1 to FIG. 10 (refer to FIG. 5 and FIG. 6), consists of synthetic resin film and so on, and is hung from and held by the U-shaped hanger 13.

At the back side of a number of receiving bags 4 which are hung and held, the compression plate 14 is provided along the hanger 13 so as to be movable, and the compression plate 14 is always given momentum to move towards the receiving bag 4 side by a compression mechanism 56.

Figure 14:
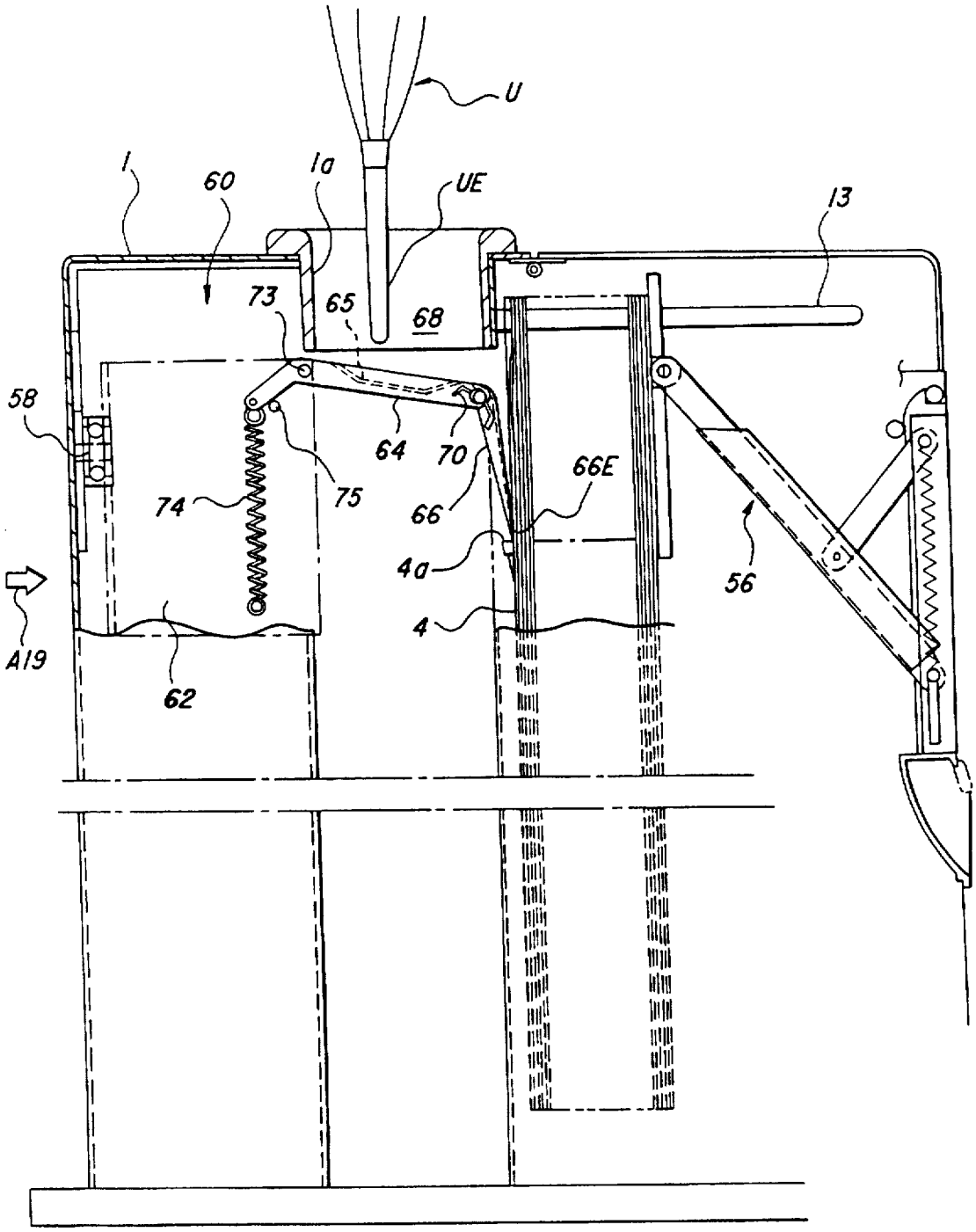
FIG. 14 is an enlarged partial sectional view illustrating the operation of an opening operation mechanism for opening the receiving bag and having it receive an umbrella.

The opening operation mechanism 60 which is provided within the mechanism molding case 7 and operates so as to open the insertion opening 4*a* of the receiving bag 4 is described in reference to FIG. 13 and FIG. 14.

In FIG. 14, the opening operation mechanism 60 includes a movable plate 62 which is attached to the main body 1 so as to be free to rotate by a bearing 58, a first member 64 which is attached to the movable plate 62 so as to be free to rotate, and a second member 66 which is free to rotate towards the first member 64 and is entirely of a spatula shape. At a shaft supporting part 68 of the first member 64 and the second member 66, an elastic member (a return spring) 70 which gives the second member 66 momentum to move upwards or in the direction in which the second member 66 abuts to the above-described receiving bag 4 (the right side in FIG. 4) is provided.

In FIG. 14, a mark U illustrates an umbrella, and a mark UE illustrates a point portion. The point portion UE of the umbrella abuts to a concave part formed on the first member 64, that is, a receiving part 65, when the point portion UE enters downwards through the opening 1*a* of the top portion of the main body 1.

Here, an elasticity repulsion of the return spring 70 is set so that the elasticity repulsion is enough to lift the second member 66 against gravity, but is only strong enough that the second member 66 is prevented from rolling up the receiving bag 4 when it abuts to the receiving bag 4. In FIG. 13, a mark 73 illustrates a rotation shaft of the first member 64 when rotating at the movable plate 62, and a mark 74 illustrates a spring which gives the movable plate 62 momentum to return to the position illustrated in FIG. 14 when the movable plate 62 rotates towards the main body (details are described later), while a mark 75 illustrates a stopper which limits the return of the first member 64 by the spring 74.

Next, the operation of the opening operation mechanism 60 is described with reference to FIG. 15 to FIG. 18.

Figure 15:
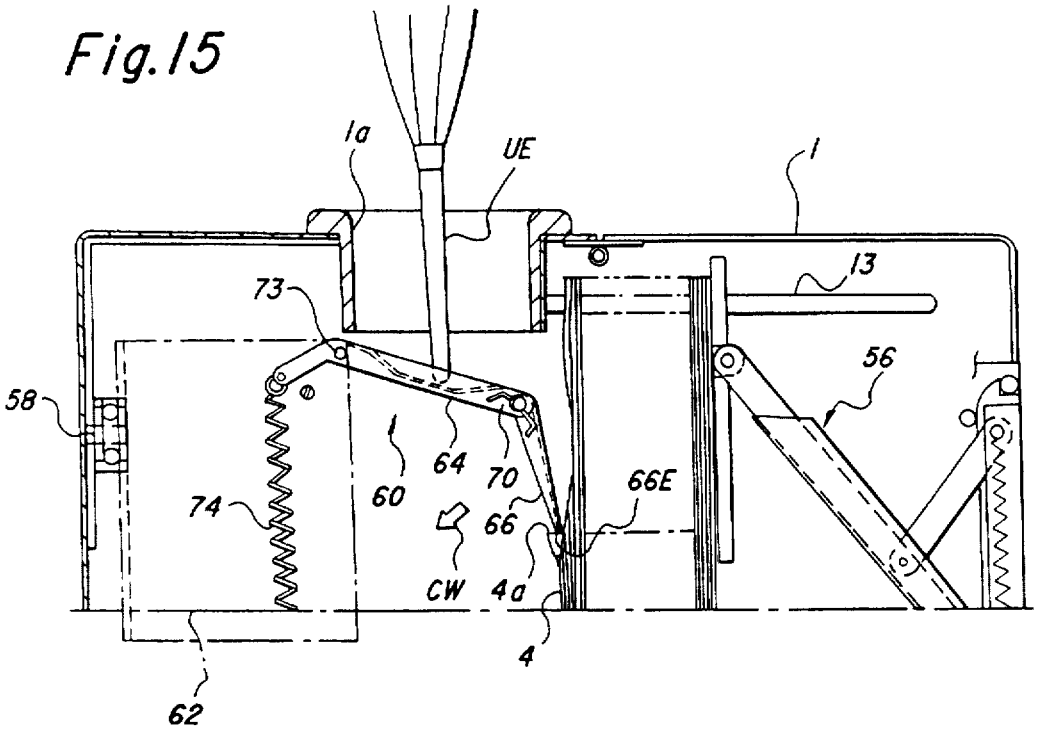
FIG. 15 is an enlarged partial vertical section illustrating a different step of receiving an umbrella from that of FIG. 14.

As FIG. 15 illustrates, when the point portion UE of the umbrella enters the inside of the main body 1 of the device through the opening 1*a* and abuts to the receiving part 65 of the first member, the entire body of the opening operation mechanism 60 rotates around the shaft 73 in a clockwise direction (the direction illustrated by the arrow CW), and the front end portion 66E of the second member 66 advances into the opening 4*a* of the receiving bag 4.

Figure 16:
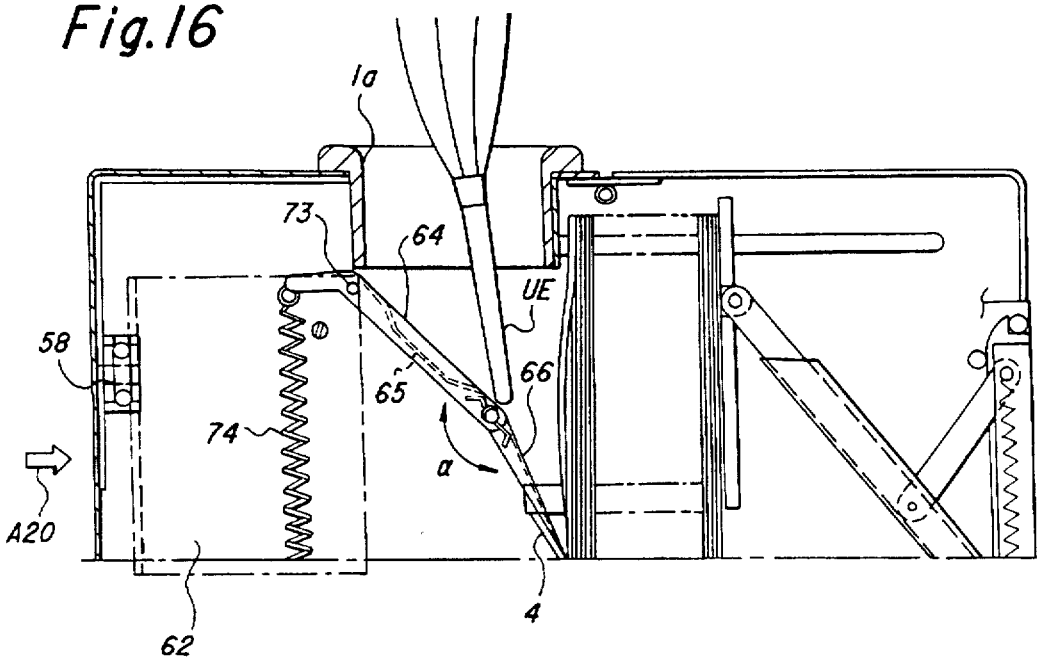
FIG. 16 is an enlarged partial vertical section illustrating a different step of receiving an umbrella from that of FIG. 15.

When the point portion UE of the umbrella in the state of FIG. 15 is pressed further downward, the second member 66 advances further into the receiving bag 4 (FIG. 16). In the state illustrated in FIG. 16, by the action of the return spring 70, an angle a, which is made by the first member 64 and the second member 66, becomes larger compared to that of the state illustrated in FIG. 15 (however, the mark a is not illustrated in FIG. 15), the point portion UE of the umbrella, which is removed from the receiving part 65, moves to the second member 66 side, in other words, to the receiving bag 4 side, so that the second member 66 opens the opening 4*a* of the receiving bag 4 widely.

Figure 17:
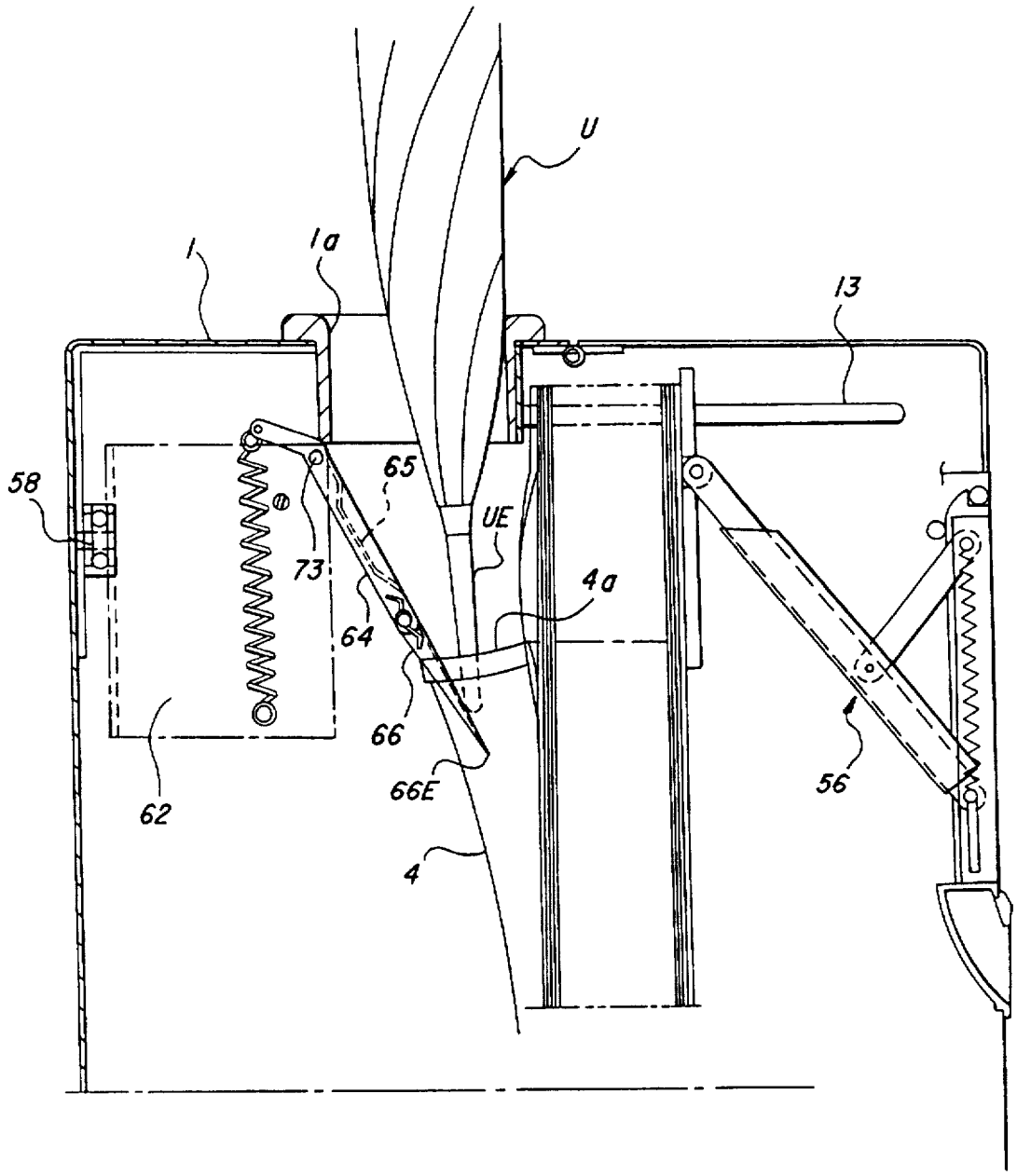
FIG. 17 is an enlarged partial vertical section illustrating the opening operation mechanism in a step different from those of FIG. 14 to FIG. 16.

When the umbrella U (of which the point portion UK) which is in the state of FIG. 16 is further pressed down, it is in the state illustrated in FIG. 17. In this state, wherein the receiving bag 4 is further widely opened by the second member 66, the point portion UE of the umbrella reaches a proximity to the front end position of the second member 66, and enters the inside of the receiving bag 4. There, in the state of FIG. 17, wherein the second member 66 further rotates in a counter clockwise direction by the action of the return spring 70, the first member 64 and the second member 66 are approximately in a straight line.

As is obvious when comparing FIG. 15, FIG. 16, and FIG. 17, the point portion UE of the umbrella is guided into the receiving bag 4 from the first member 64 (by the receiving part 65) by the first and the second members, 64 and 65. That is to say, the opening operation mechanism 60 performs a function of guiding the point portion UE of the umbrella.

Figure 18:
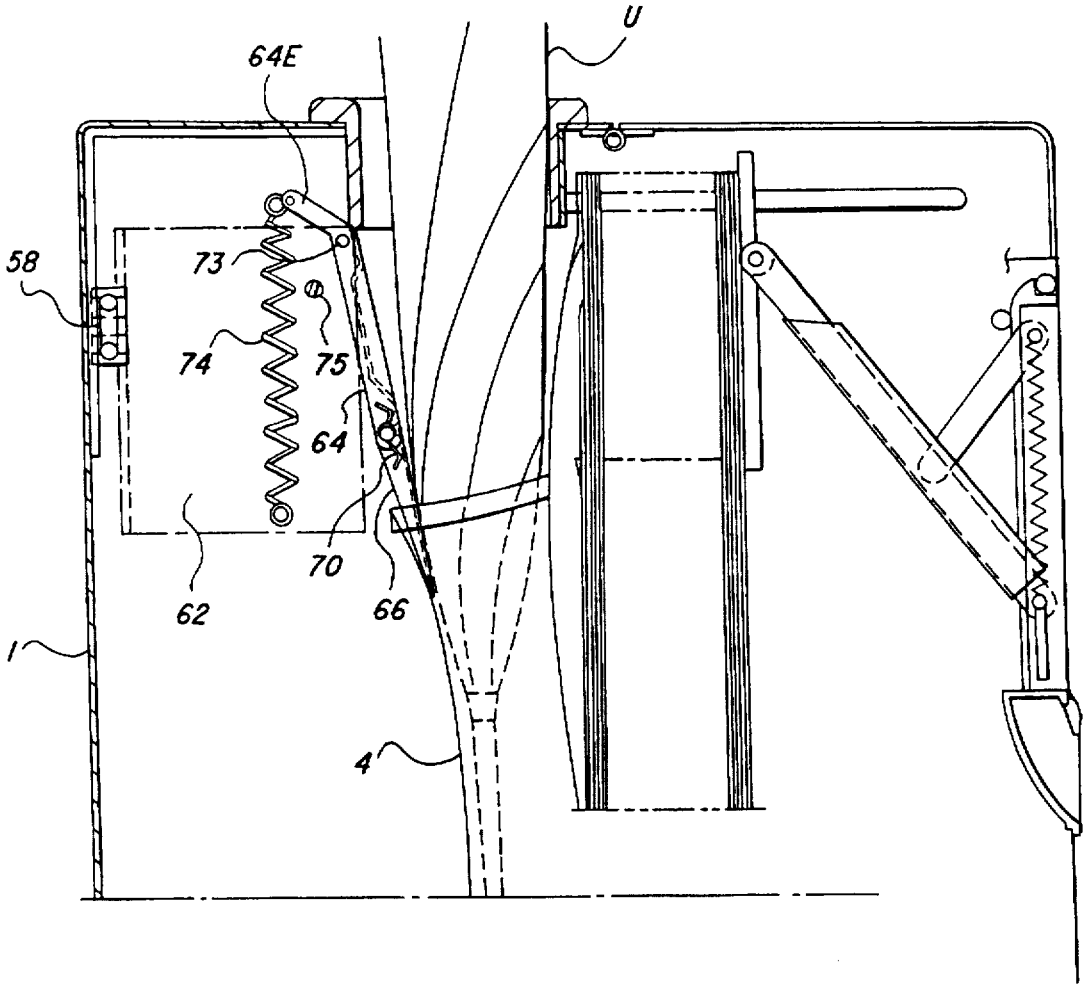
FIG. 18 is an expanded partial sectional view illustrating the opening operation mechanism in the state that the umbrella is further deeply pressed down.

When the umbrella U which is in the state illustrated in FIG. 17 is pressed further downwards (within the main body 1 of the device), it is in the state illustrated in FIG. 18. Then, when the umbrella U is completely received in the receiving bag 4 and the receiving bag 4 and the umbrella U are removed from the main body 1 of the device in a way described later with reference to FIG. 19 to FIG. 22, an entire body of the opening operation mechanism 60 returns to the state illustrated in FIG. 14.

There, the spring 74 gives momentum for the entire body of the mechanism 60 to return to the position illustrated in FIG. 14, and the spring 74 activates the tension force which pulls the back end portion 64E (FIG. 18) of the first member 64 to the position which abuts to the stopper 75.

Meanwhile, in the state illustrated in FIG. 17 and FIG. 18, the first member 64 and the second member 66 are in a straight line, and the angle a illustrated in FIG. 16 is approximately 180 degrees. In order to return the opening operation mechanism 60 to the state illustrated in FIG. 14, the angle a is required to be made small against the repulsion of the return spring 70. However, the elasticity repulsion of the return spring 70 is set so that it is enough to lift the second member 66 against gravity, but is only strong enough that no rolling of the receiving bag 4 takes place when the second member 66 abuts to the receiving bag 4, and even if the spring is strong, the second member 66 gently returns to its original position against the receiving bag (a polyethylene bag) in such a way as it so called "edges back" so that the load does not fall on the receiving bag (a polyethylene bag).

When the entire body of the opening operation mechanism 60 rotates in a counter clockwise direction by the spring 74, and the member 66 abuts to the receiving bag 4, the member 66 bends in a clockwise direction to the first member 64 without rolling up the receiving bag 4, making the above-described angle a small, and when the back end portion 66E of the second member 66 abuts to the stopper 75 the second member 66 returns to the position illustrated in FIG. 14.

Next, the operation of the movable plate 62 mainly described in relation to the operation of the opening operation mechanism 60 described in FIG. 14 to FIG. 18 with reference to FIG. 19 to FIG. 22. In FIG. 19 to FIG. 22, a mark 80 shows a spring for returning the movable plate 62.

Figure 19:
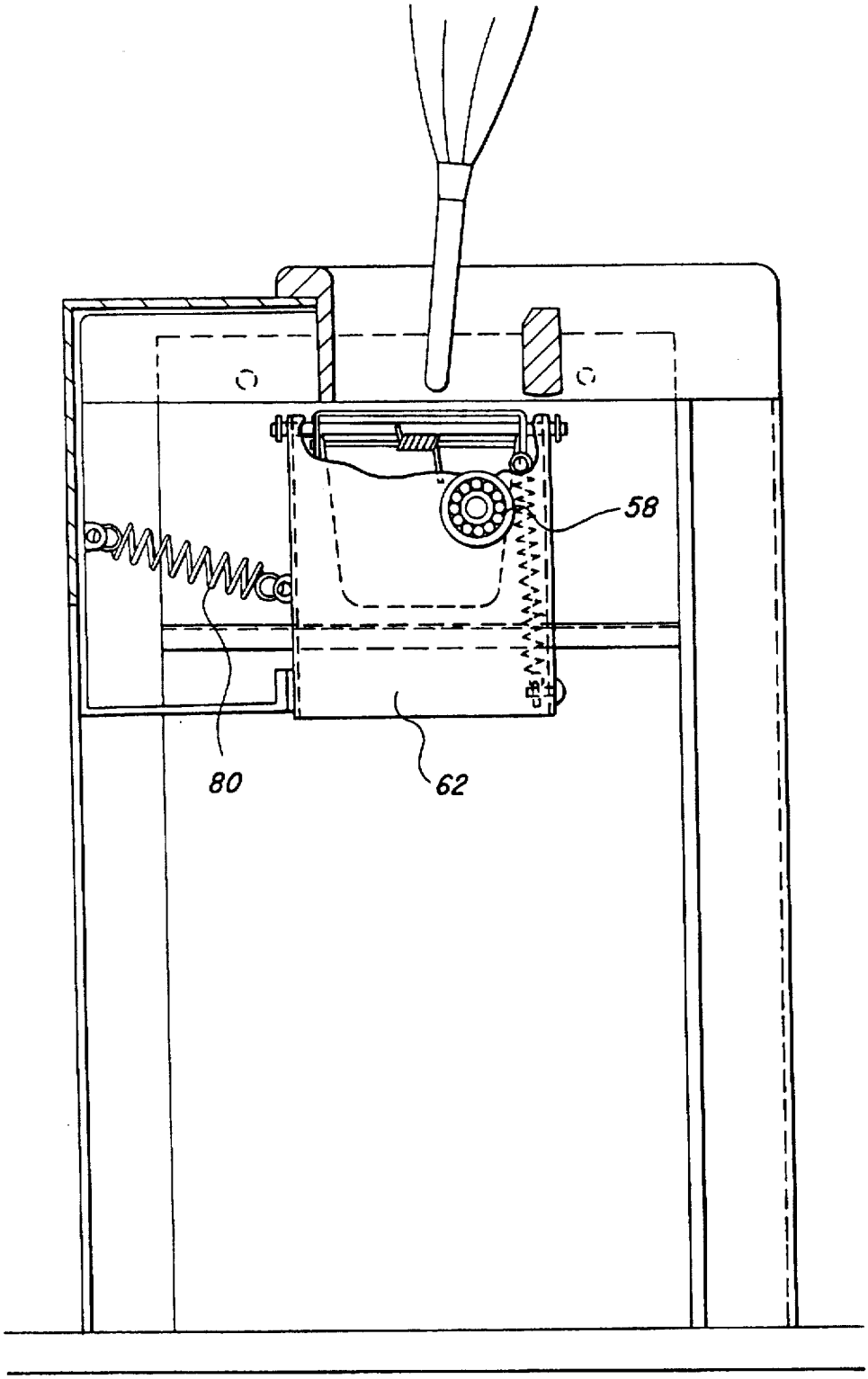
FIG. 19 is a view seen from the direction of an arrow A19 of FIG. 14.
Figure 20:
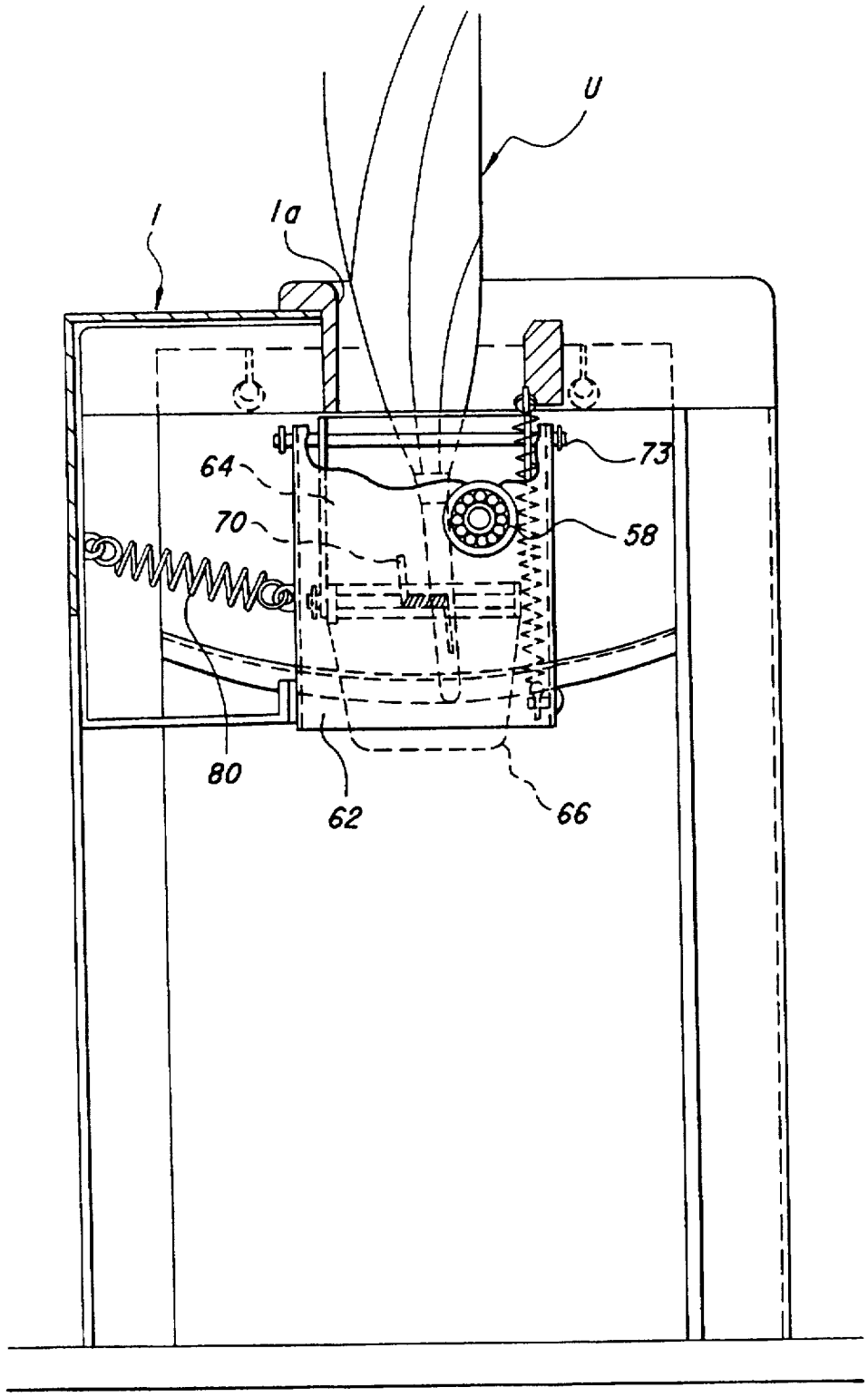
FIG. 20 is a view seen from the direction of an arrow A20 of FIG. 16.
Figure 21:
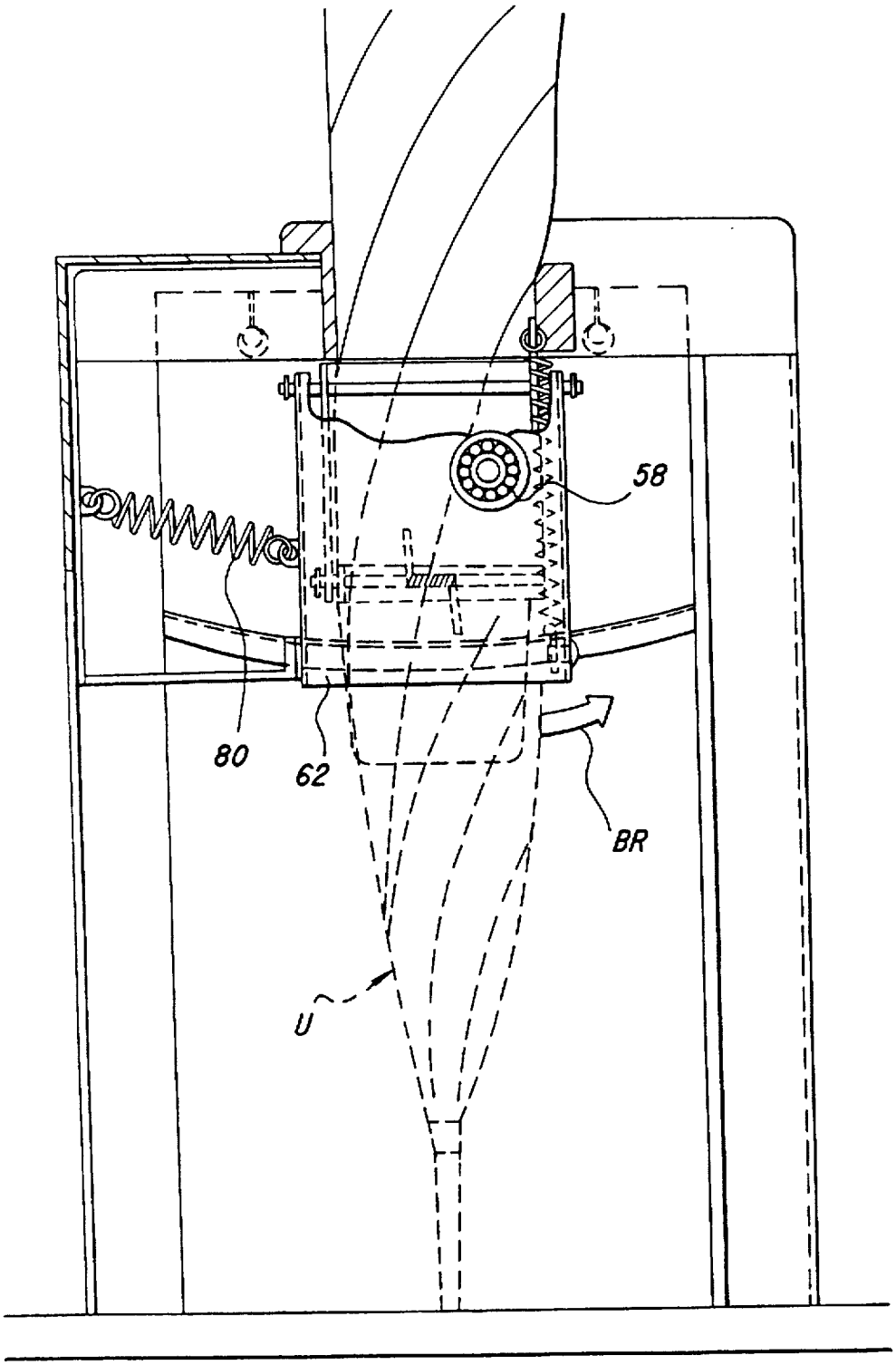
FIG. 21 is a partial sectional side elevation view illustrating the state in which the umbrella as illustrated in FIG. 20 is even further deeply inserted.

FIG. 19 is the state of FIG. 14 which is seen from a different angle (in the direction illustrated by a mark "A19" in FIG. 14), and FIG. 20 is the state of FIG. 16 which is seen from the direction illustrated by a mark "A20" (FIG. 16), while FIG. 21 is in the state where the umbrella U in FIG. 18 is further deeply pressed down and is seen from the direction of FIG. 19 and FIG. 20. In FIG. 19 to FIG. 21, the illustrations of the receiving bag 4 and the description of the operation of the opening operation mechanism 60 are abbreviated.

Figure 22:
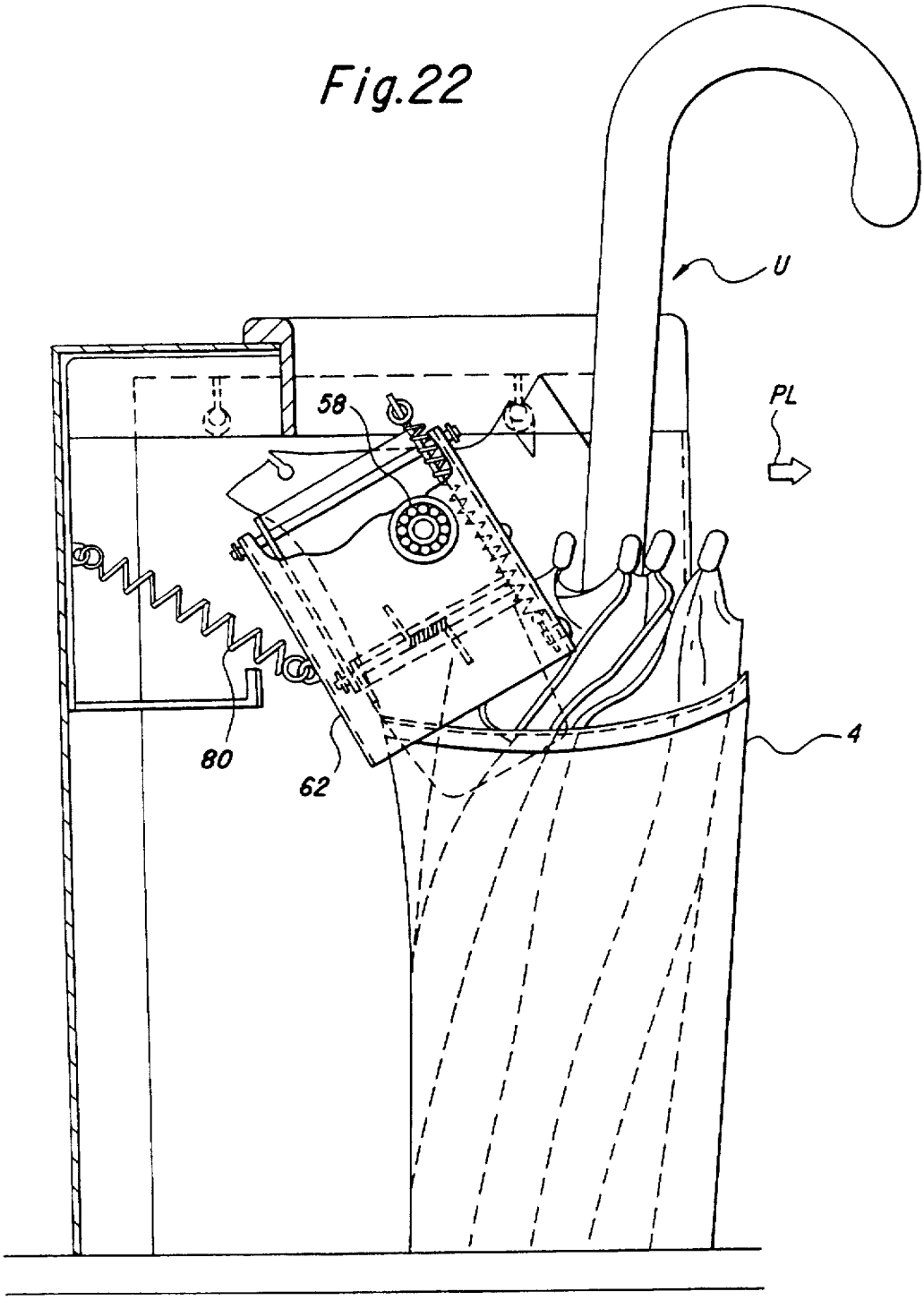
FIG. 22 is a sectional side elevation view illustrating the state that a mobile plate rotates.

When the umbrella U in the state of FIG. 21 is further pressed downwards and the umbrella U is completely received in the receiving bag 4, it is required that the receiving bag (more precisely, a pair of hanger holes which are formed on the upper end portion 42*a*) is torn off and the umbrella U which has been taken in the receiving bag 4 is removed from the main body 1 of the device. FIG. 22 illustrates such a step, and when the umbrella U is pulled in the direction of an arrow PL through the opening 1*b* (FIG. 11) in order to remove the umbrella U outside of the main body 1 of the device in FIG. 22, the movable plate 62 rotates around a bearing 58 as a rotation center from the position, illustrated in FIG. 19 to FIG. 21, towards the direction of an arrow BR (FIG. 21) to be in the state illustrated in FIG. 22. When the umbrella U is further pulled in the direction of the arrow PL the bag 4 is torn off from the hanger holes 4*b* and is removed (is torn off) from the hanger 13.

When the bag 4 is torn off from the hanger 13, the movable plate 62 returns to the position of FIG. 19 again by the elasticity tensile force of a spring 80.

Next, another embodiment of the present invention is further described with reference to FIG. 23 to FIG. 31. The detailed descriptions of the same members as those of FIG. 1 to FIG. 22 are abbreviated by giving the same marks to them.

Figure 23:
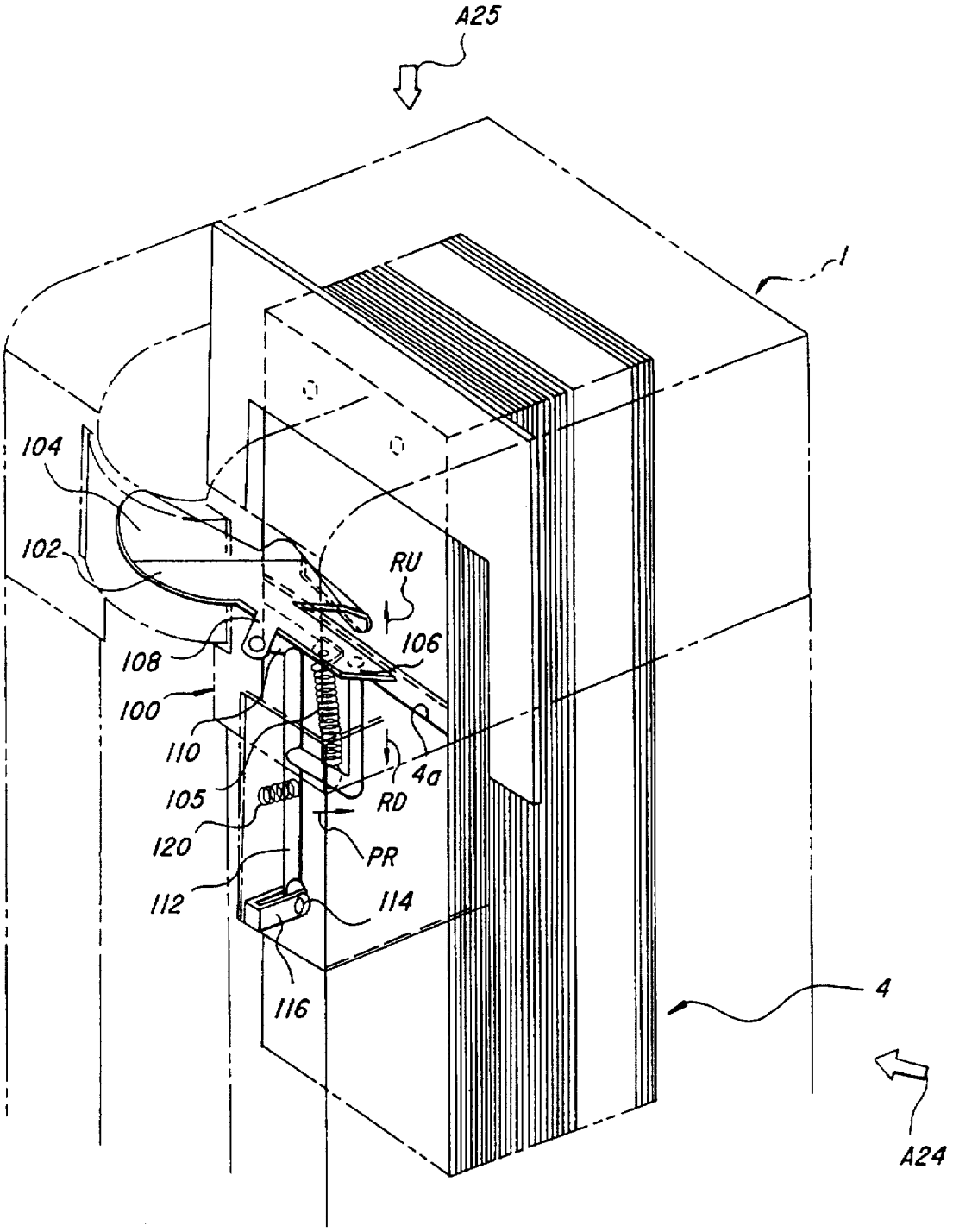
FIG. 23 is a perspective view illustrating an essential part of another embodiment of the present invention.

In FIG. 23, an opening operation mechanism of which an entire body is shown by a mark 100 is attached to the main body 1 of the device wherein a number of receiving bags 4 for umbrellas are contained. This opening operation mechanism 100 has a fragmentary member 102, which is a receiving part to which the point portion of the umbrella (not illustrated in FIG. 23) abuts, and is approximately arranged by an opening guide member 104 which opens the insertion opening 4*a* of the receiving bag 4 and is also a guiding part which guides the point portion of the above-described umbrella to the insertion opening 4*a* which is opened, a tensile force operation part 106 to which a tension spring 105, which gives momentum to the mechanism 100 to return to the state illustrated in FIG. 23 after the umbrella has been received in the bag, is attached, and a rotational shaft supporting member 108 which supports a link (a rotational shaft) described below.

Supported by the rotational shaft supporting member 108 is a first link 110 which is positioned slanting to the horizontal surface and arranges a rotational shaft of the above-described fragmentary member 102. This first link 110 is fixed to a front end portion (an upper end portion) of a second link 112, and freely rotates towards a base part 116 by a shaft 114. In other words, the second link rotates within the vertical surface including the base part 116. The base 116 is fixed to the main body 1 of the device.

From the second link 112, a third link 118 is branched (the first and the third links 112 and 118 are formed to be one body). One end portion of the tension spring 105 (the first elasticity means which gives momentum to the fragmentary member to return to its position before the fragmentary member rotated around the first link) is attached to the third link 118 and the other end portion of the spring 105 is fixed to the tensile force operation part 106 of the fragmentary member 102. An upper end portion of the third link 118 acts as a stopper which stops the fragmentary member 102 rotating in the direction of an arrow RD by the tensile force of the tension spring 105.

At a midway part of the second link 112, a compression spring 120 which is a second elasticity means gives momentum to the link 112 to move to the receiving bag 4 side. By this compression spring 120, the fragmentary member 102 is given momentum to move in the direction of an arrow PR in FIG. 23 and is always compressed against the receiving bag 4 at a predetermined pressure.

Figure 24:
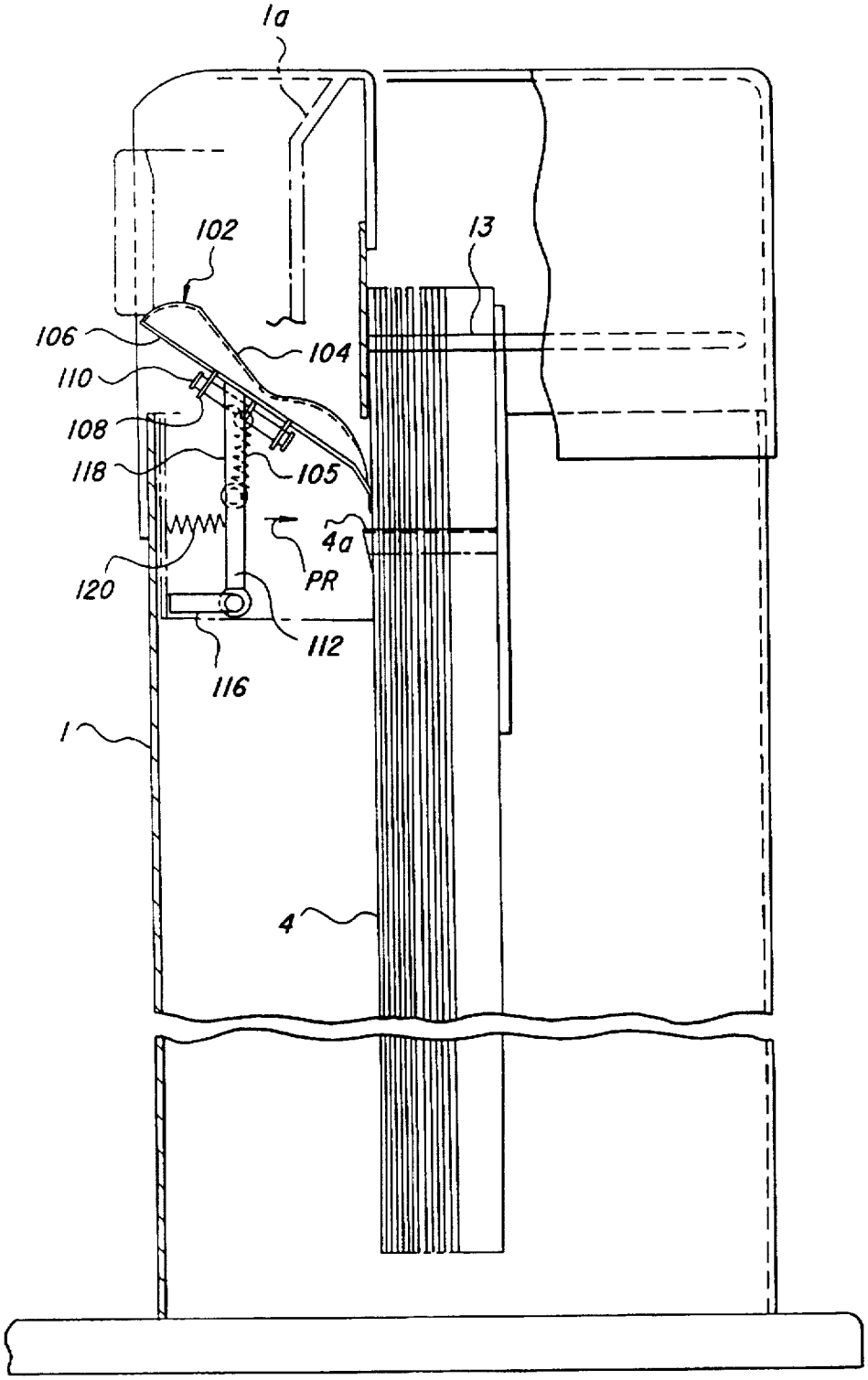
FIG. 24 is a view seen from the direction of an arrow A24 of FIG. 23.
Figure 25:
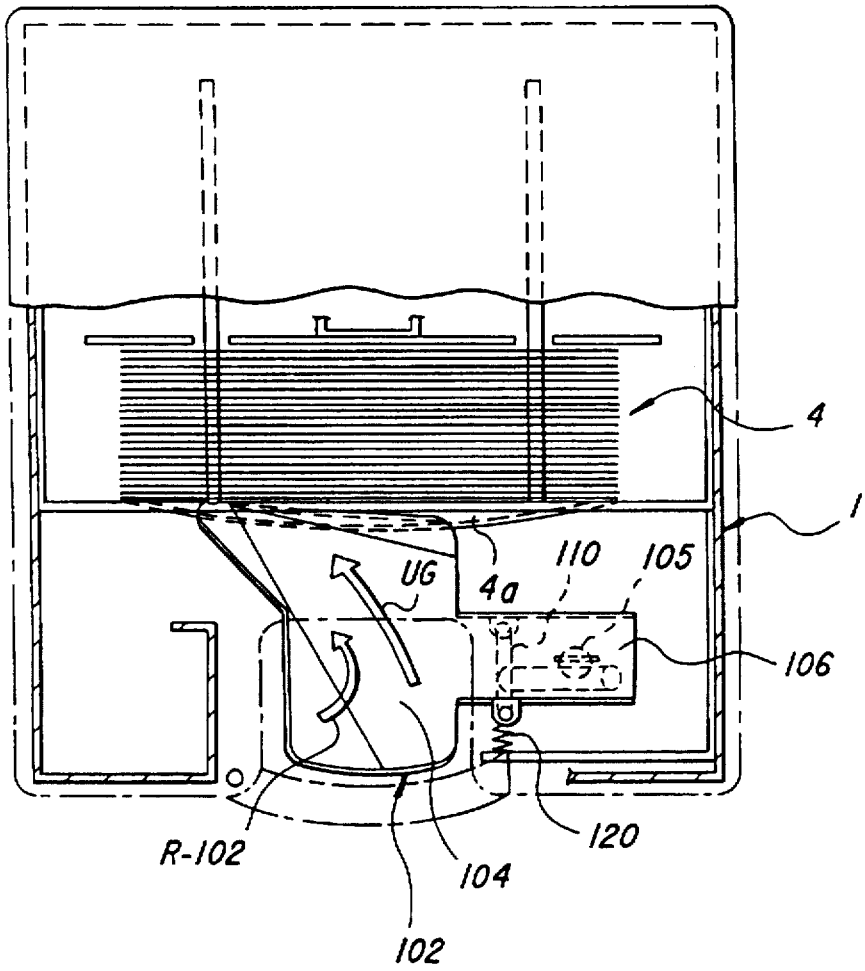
FIG. 25 is a view seen from the direction of an arrow A25 of FIG. 23.

FIG. 24 is a drawing of the mechanism (except for a casing part of the main body 1 of the device) of FIG. 23 which is seen from the direction of an arrow A24 of FIG. 23, and FIG. 25 is a drawing of the same mechanism of FIG. 23 which is seen from the direction of an arrow A25. In FIG. 25, an arrow shown by a mark UG is a locus of the umbrella (not illustrated in FIG. 25) when it is guided by the fragmentary member 102, and an arrow shown by a mark R-102 is an action made by the fragmentary member 102 when it is compressed by the point portion of the umbrella.

Next, the operation of this embodiment is described with reference to FIG. 26 to FIG. 31.

Figure 26:
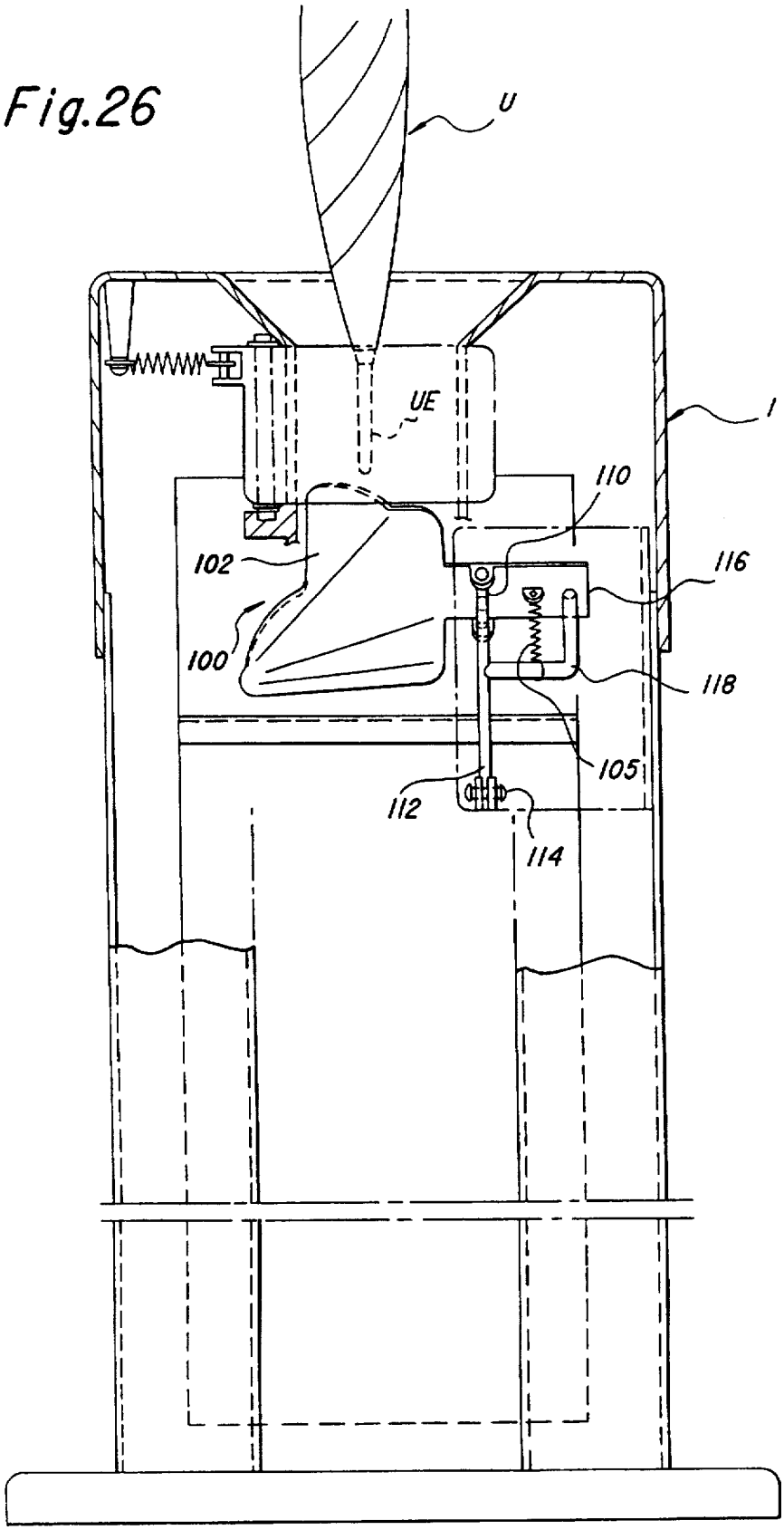
FIG. 26 is a front sectional diagram illustrating the opening operation mechanism which is in the state in which it is not compressed by an umbrella.
Figure 27:
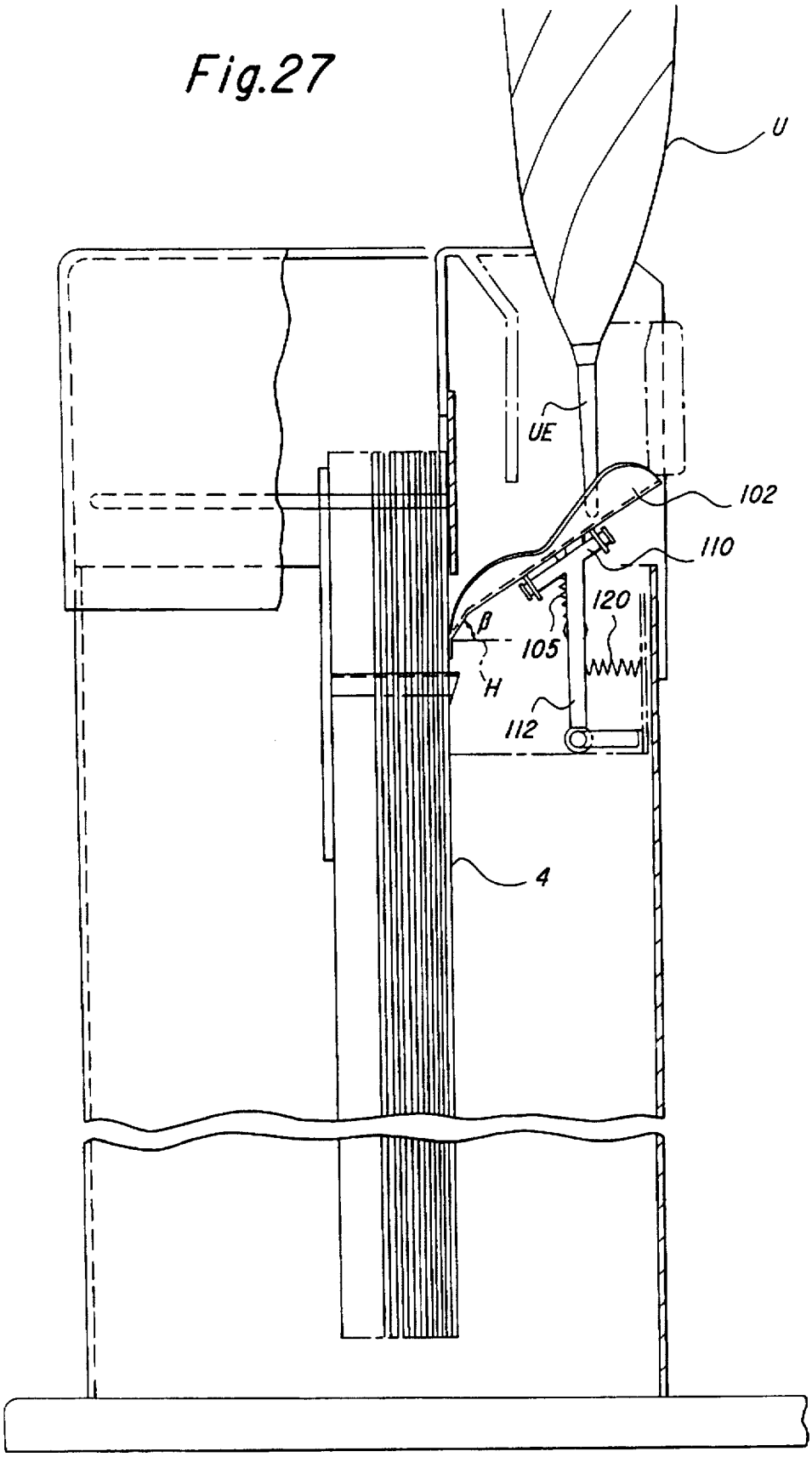
FIG. 27 is a sectional side elevation view illustrating the opening operation mechanism which is in the state just before it is compressed by an umbrella.

The state illustrated in FIG. 26 shows the state before the opening operation mechanism 100 operates, and in this state, the point portion UE of the umbrella U does not abut to the fragmentary member 102. FIG. 27 illustrates the state just before the point portion UE of the umbrella abuts to the fragmentary member 102. As is obvious from FIG. 17, in the state where the umbrella (of which the point portion) does not abut to the fragmentary member 102, an angle B which the fragmentary member 102 makes to a horizontal surface H is about 30 degrees.

Figure 28:
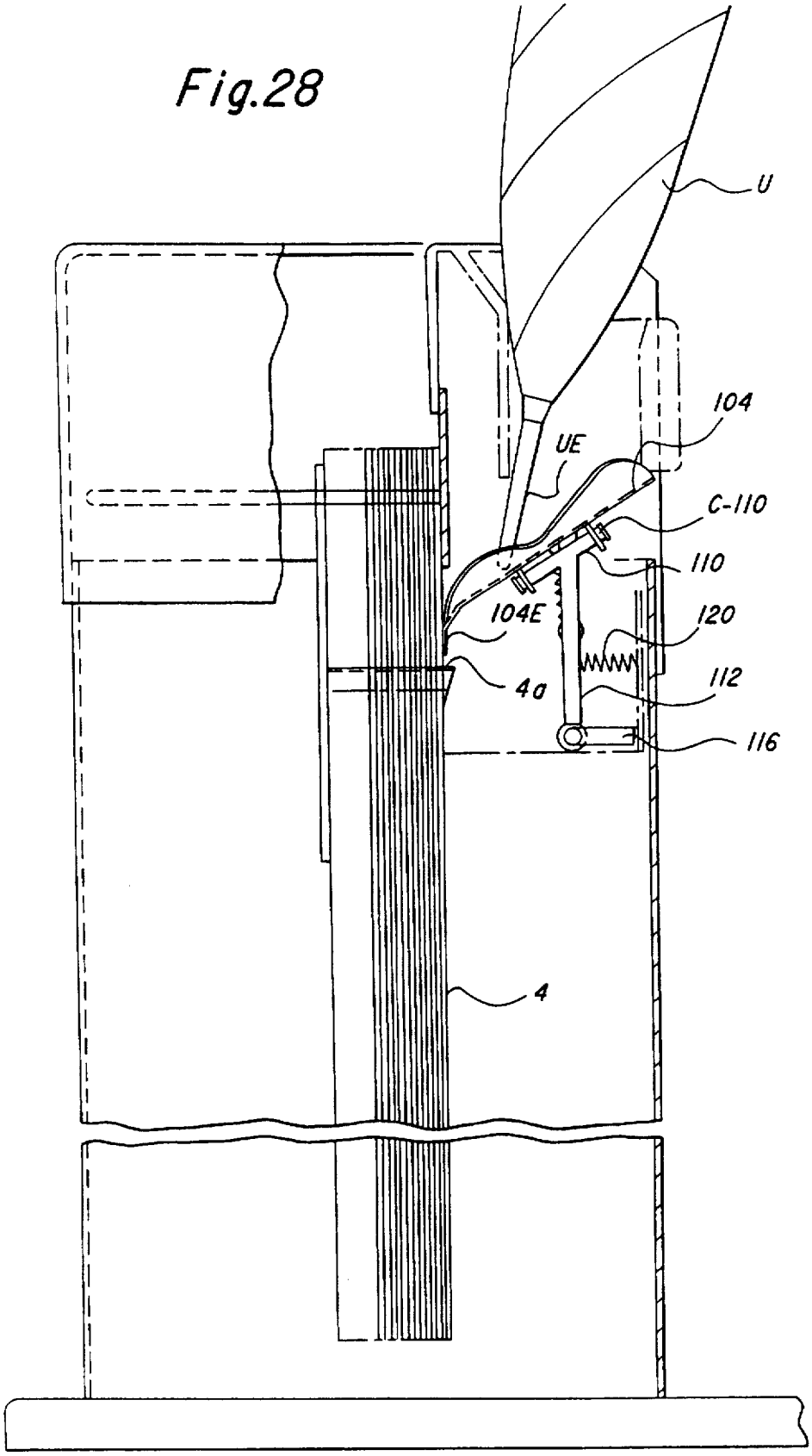
FIG. 28 is a sectional side elevation view illustrating the opening operation mechanism which is in a state in which the umbrella of FIG. 27 is even further compressed.

The point portion UE of the umbrella in the state of FIG. 27 is further pressed downwards, the point portion UE moves on the opening guide member 104 of the fragmentary member 102 as FIG. 28 illustrates. There, the direction in which the point portion UE moves is illustrated by the arrow UG in FIG. 25. The fragmentary member 102 rotates around the first link 110 as a rotation shaft (the center line of the rotation shaft is illustrated by a dashed line C-110 in FIG. 28) against an elasticity tensile force of the tension spring 105 at the same time as the point portion UE of the umbrella moves on the opening guide member 104. The direction in which the fragmentary member 102 (or the opening guide member 104) rotates is the direction shown by an arrow RU in FIG. 23.

Figure 29:
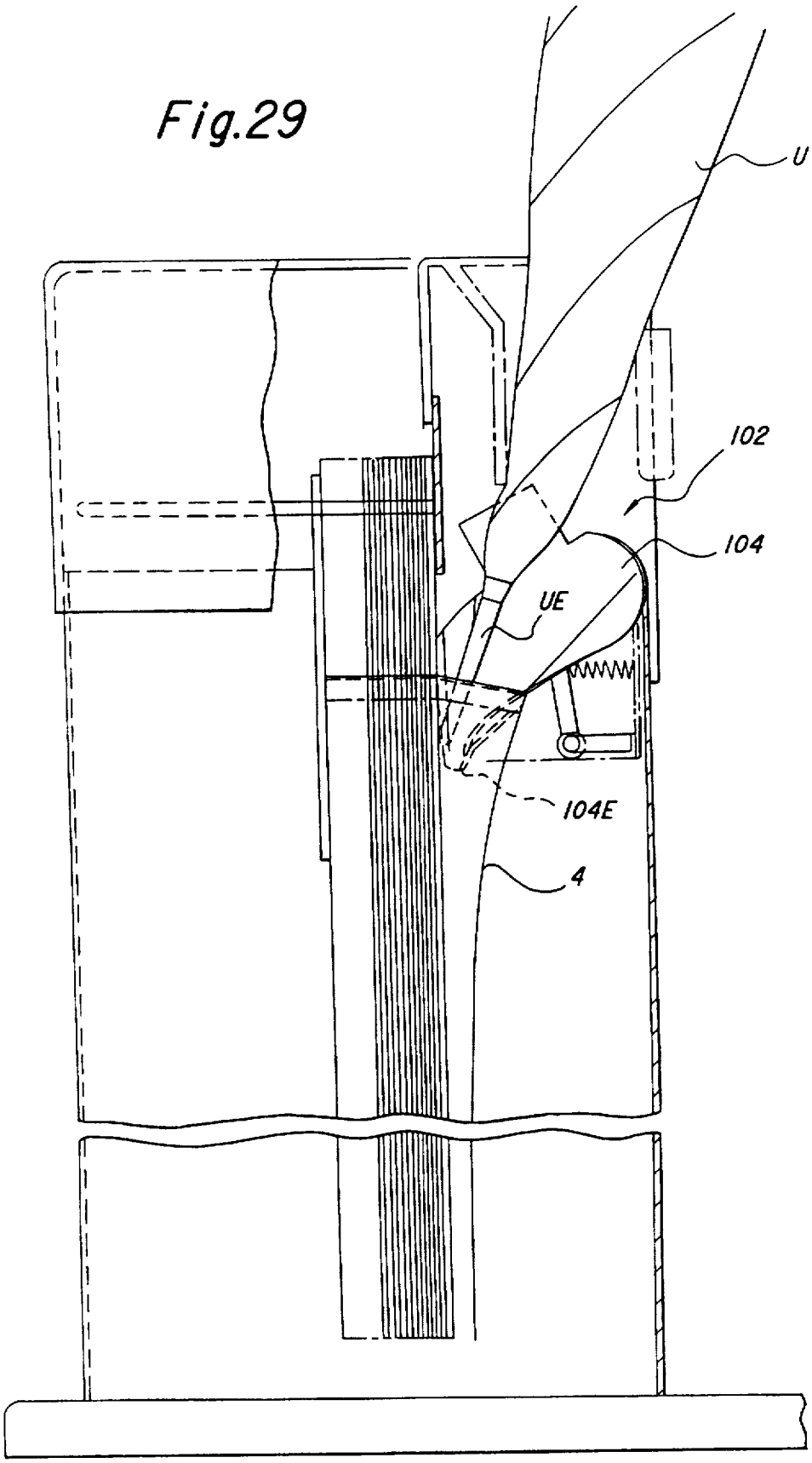
FIG. 29 is a sectional side elevation view illustrating a state in which the umbrella of FIG. 28 is even further compressed.

When the umbrella U is pressed downwards and the fragmentary member 102 (or the opening guide member 104) rotates, the state becomes as FIG. 29 illustrates. Then returning to FIG. 28, the lower end portion 104E of the opening guide member 104 is at the position right above the insertion opening 4*a* of the receiving bag 4; and when the fragmentary member 102 rotates as is described above, the lower end portion 104E enters the inside of the receiving bag 4 through the insertion opening 4*a*.

As FIG. 29 illustrates, when the point portion UE of the umbrella is further pressed downward, the fragmentary member 102 further rotates, and the opening guide member 104 further enters the inside of the receiving bag 4. The fragmentary member 102 which is in the shape illustrated in the drawing has the width dimension which increases as it goes from the lower end portion to the upper direction, so that the insertion opening 4*a* is opened widely as the lower end portion 104E is entering the inside of the receiving bag 4. There, the point portion UE of the umbrella which compresses the opening guide member 104 moves on the member 104 (refer to the locus illustrated by an arrow UG of FIG. 25), and enters the inside of the receiving bag 4 through the insertion opening 4*a* which is widely opened.

Figure 30:
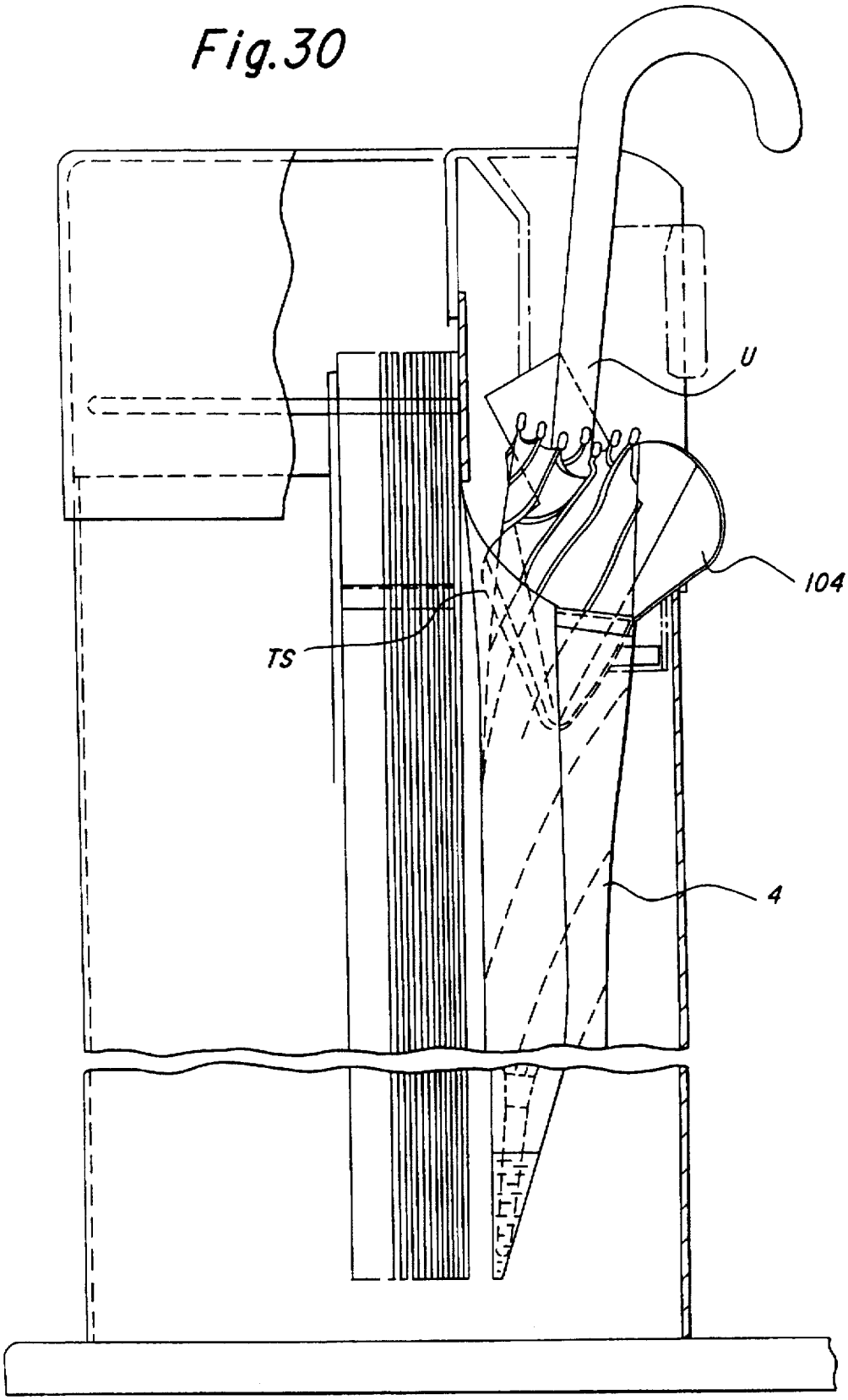
FIG. 30 is a sectional side elevation view illustrating the state in which an umbrella is received in the receiving bag.
Figure 31:
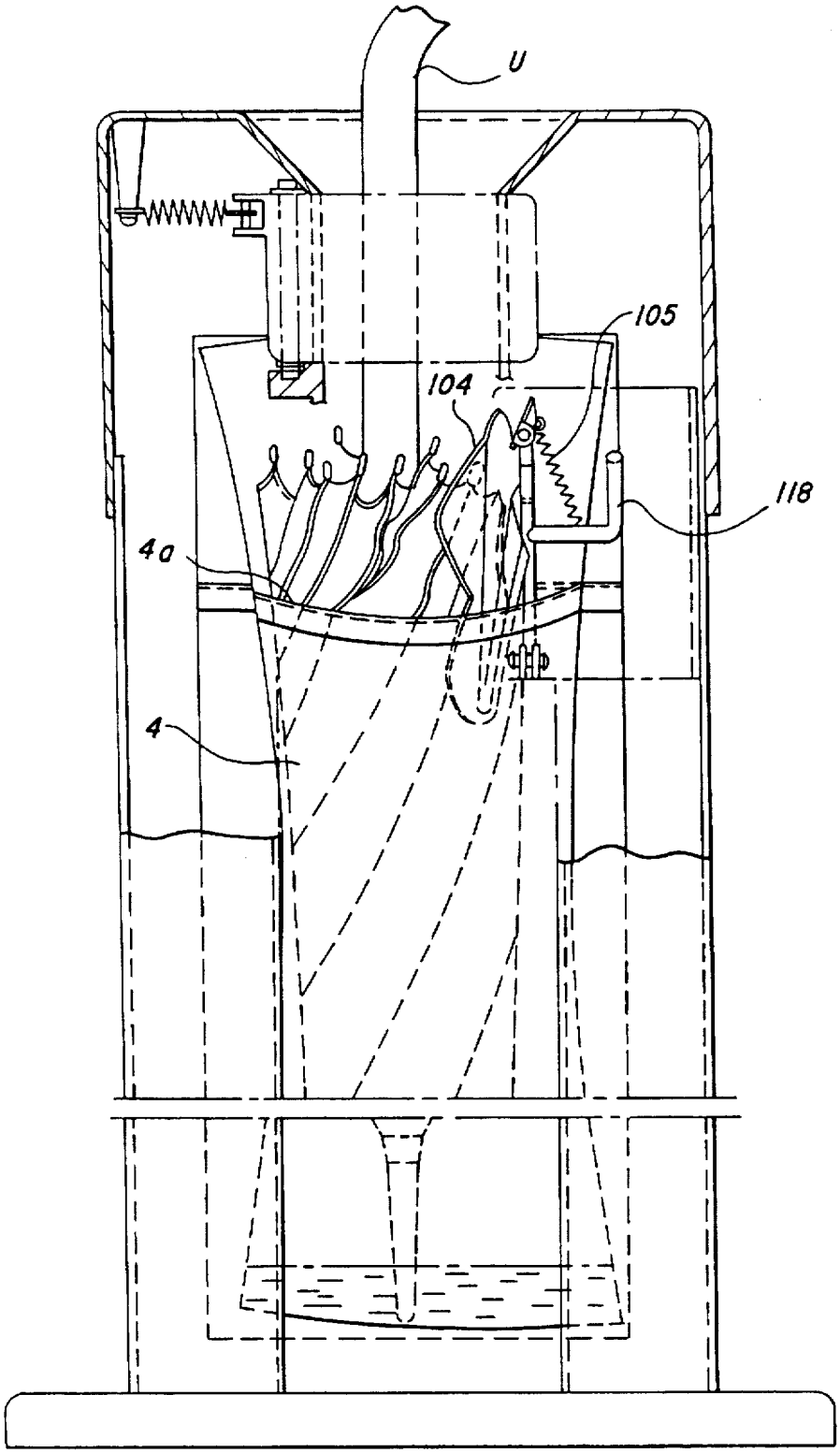
FIG. 31 is a front sectional view of the state of FIG. 30.

By this, when the umbrella U is further pressed downwards, it will be in the states illustrated in FIG. 30 and FIG. 31. In the same way as the above-described embodiments, when force is given to the umbrella U to the outside of the main body 1 of the device, the upper part is torn off from the hanger holes 4*b* of the upper part of the receiving bag 4, and the engagement with the hanger 13 is released, so that the umbrella U is taken out in the state where the umbrella U has been received in the receiving bag 4.

When the umbrella U is taken out, the thing which is against the elasticity tensile force of the tension spring 105 does not exist any more, so that the elasticity tensile force acts on the tensile force operation part 106 and the fragmentary member 102 rotates around the first link 110 (the rotation direction is the direction illustrated by the arrow RD in FIG. 23). In this case, the fragmentary member 102 or the opening guide member 104 contacts the new receiving bag 4 (the bag positioned next to the bag 4' which has been taken out with the umbrella U) only at the position corresponding to a mark TS in FIG. 30. Accordingly, even when the fragmentary member rotates in the direction of the arrow RD in FIG. 23, the fragmentary member does not roll up the above-described new bag (in this stage, the insertion opening 4*a* is not opened).

Even if the number of the receiving 4 becomes small as a result that a number of umbrellas U are taken in the bags 4, the opening operation mechanism 100 is compressed by the compression spring 120; therefore an inconvenience does not occur.

Figure 32:
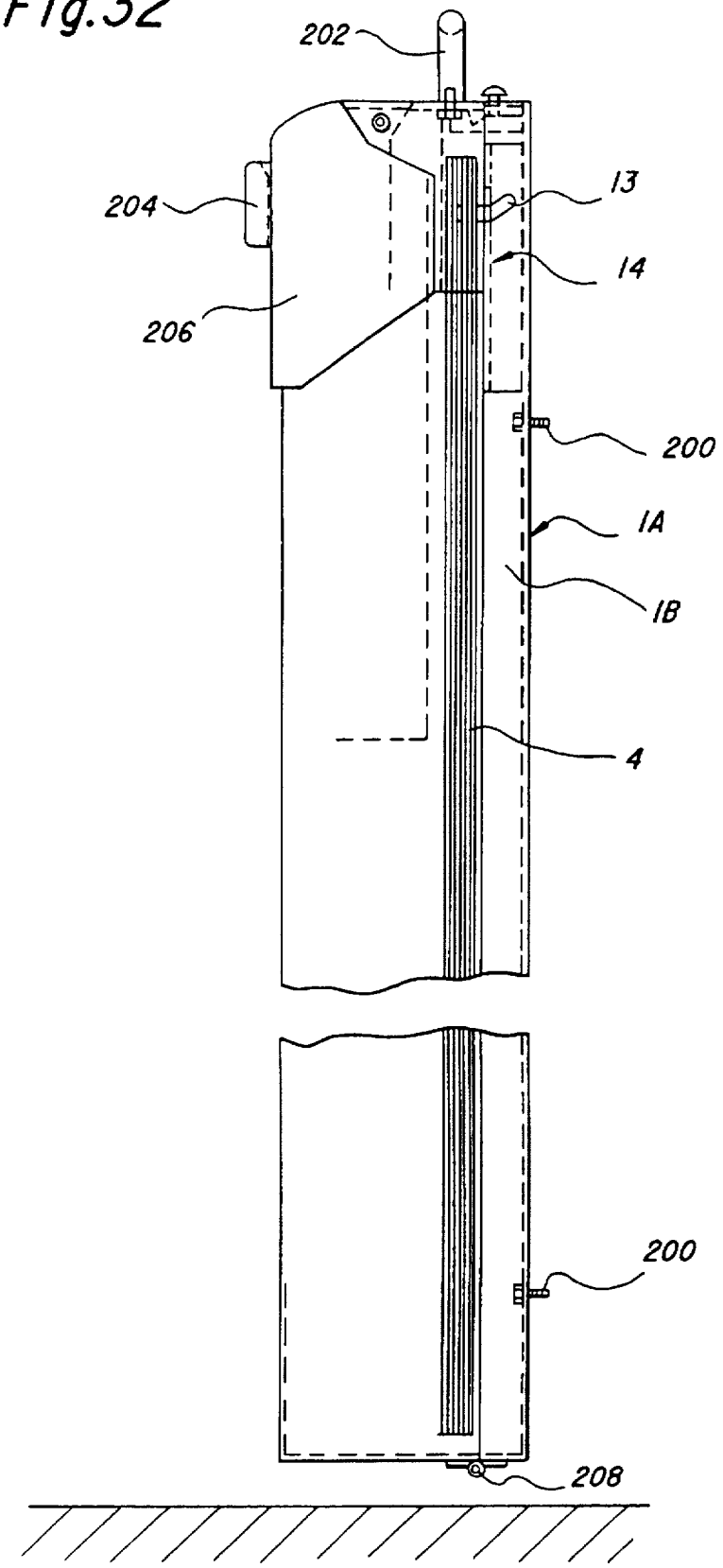
FIG. 32 is a sectional side elevation view illustrating even another embodiment of a device for automatically receiving an umbrella in a bag of the present invention.
Figure 33:
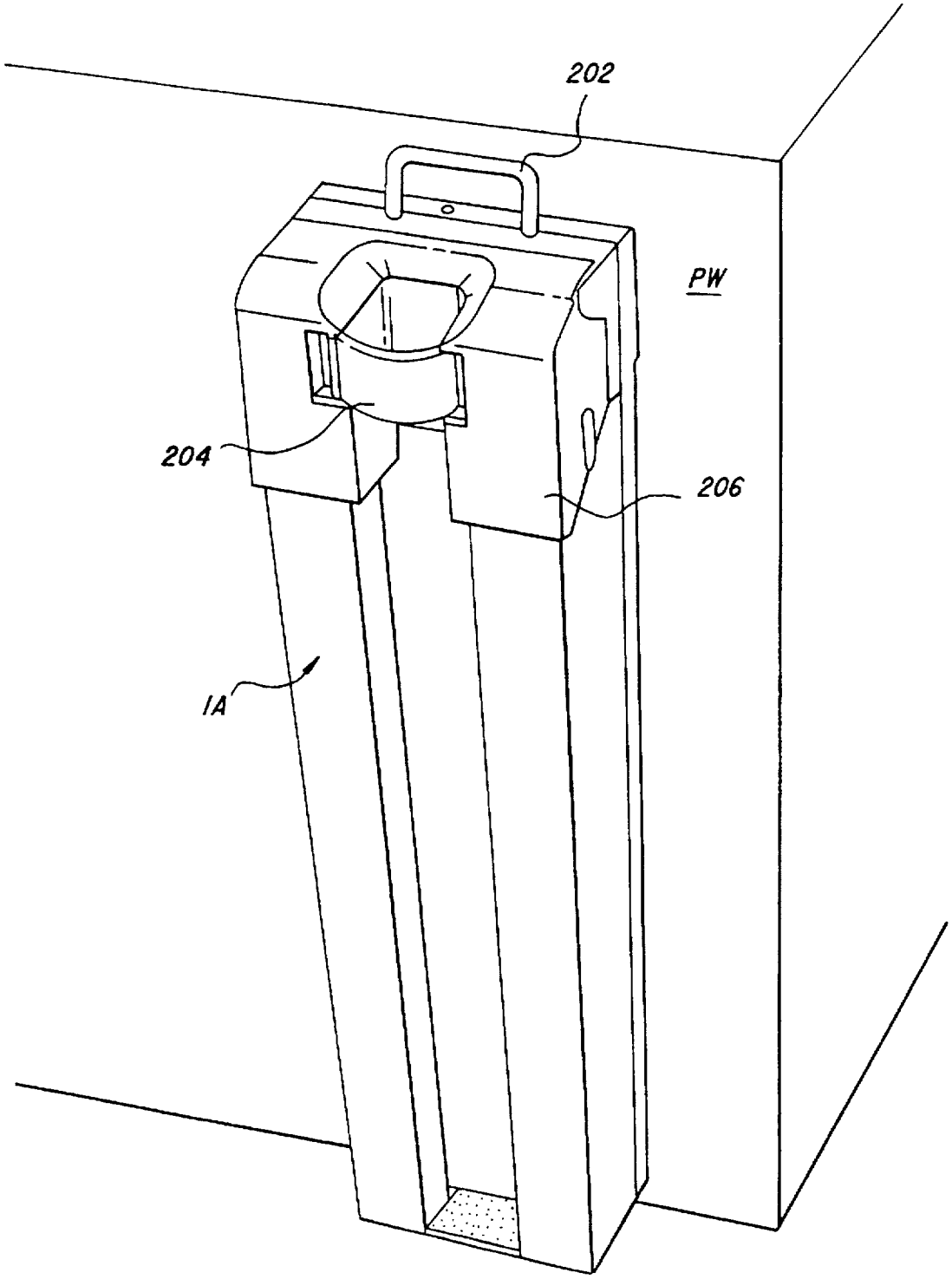
FIG. 33 is a perspective view illustrating the state that the embodiment of FIG. 32 is positioned.
Figure 34:
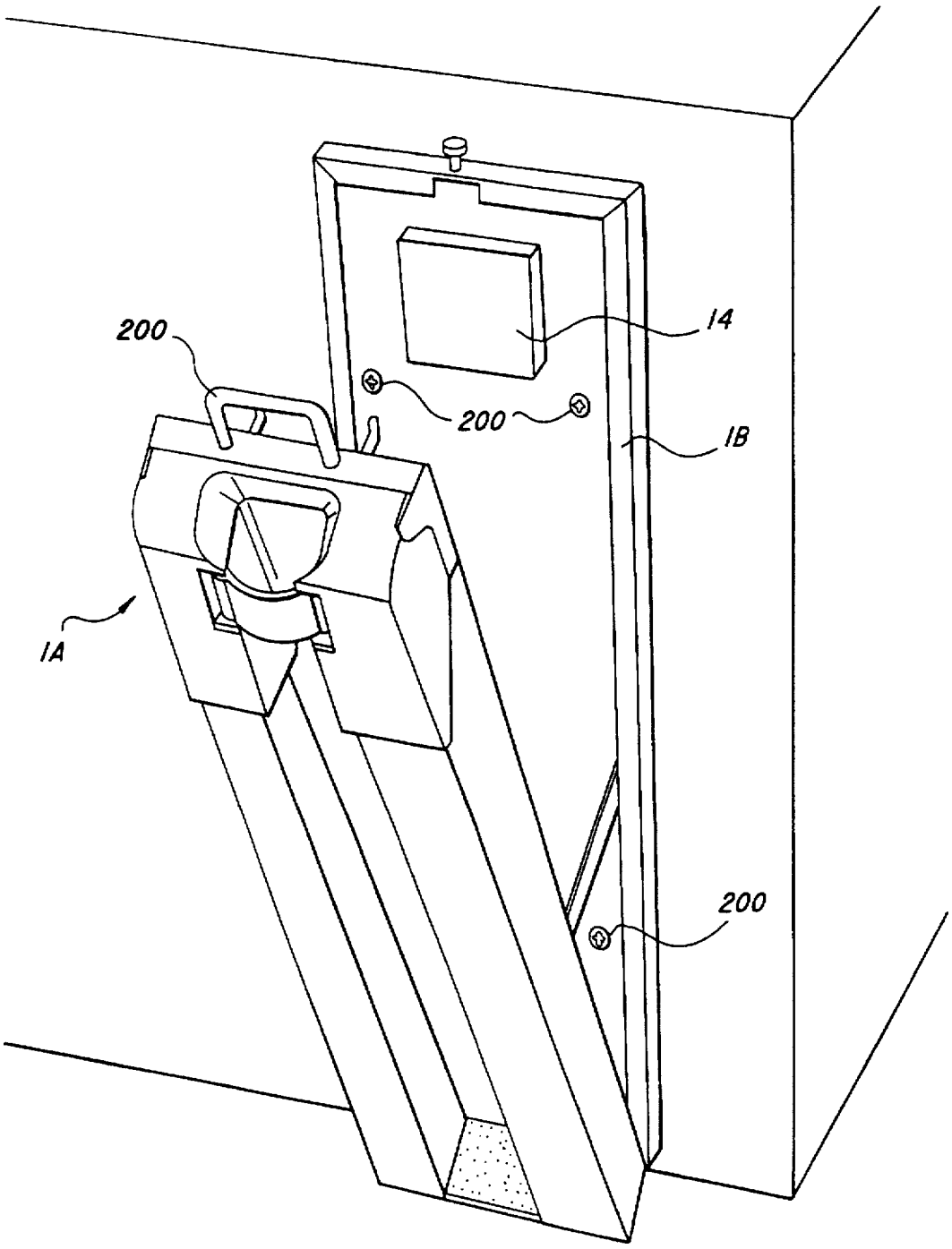
FIG. 34 is a perspective view for illustrating the operation of replenishing the receiving bags of the embodiment of FIG. 32 and FIG. 33.

The embodiment illustrated in FIGS. 32 to 34 is an object of a changed shape as a casing of the main body of the device. The embodiments of FIG. 1 to FIG. 31 premise that they are used in such places as the entrances of hotels and stores where a number of people pass by and a number of receiving bags for receiving the umbrellas are consumed. Accordingly a number of receiving bags 4 for receiving the umbrellas are required to be held within the main body 1 of the device.

On the other hand, there exists a requirement of installing a device for automatically receiving an umbrella in a bag of the present invention in narrow aisles of, for example, buses and so on. However, as described above, in the embodiments of FIG. 1 to FIG. 31 which hold a number of receiving bags for umbrellas, the longitudinal and lateral plane dimensions are comparatively large; therefore the installment in narrow aisles and so on is difficult. There, when the devices are installed in such narrow aisles, the number of the receiving bags 4 which are consumed is small compared to when installed in the hotels, stores, and so on.

In the embodiment of FIGS. 32 to 34, which is proposed with such circumstances as background, the dimension in the longitudinal direction is made smaller by as much as possible, and an umbrella can be received in a receiving bag without obstructing the way even when a device of the embodiment is placed in narrow places such as an aisle and so on. In FIG. 32, a main body (or the casing) of which the entire body is illustrated by a mark 1A as a comparatively small number of receiving bags 4 held therein (for example, about 200 bags), and has the dimension in the longitudinal direction (in FIG. 32, illustrated by an arrow F, and an arrow R) which is extremely small compared to those of the embodiments of FIG. 1 to FIG. 31. Accordingly, as FIG. 33 illustrates, the dimension which projects from a wall PW of a passage becomes extremely small.

Again in FIG. 32, a back (the direction of an arrow R) of the main body 1A of the device is a base member 1B for being attached to the main body, and attachment bolts 200 are fixed in the base member 1B. At the top portion of the main body 1A of the device, a handle 202 is provided for inclining the device when the receiving bags 4 are replenished. Further, at the front (the direction of an arrow F) of the upper part of the device, a guide 204 which furls (or wrings) an umbrella (not illustrated) in order to make it easy to be received in the bag 4 is provided, and a cover for protection 206 for protecting an opening operation mechanism which exists around the guide 204 and is for opening the bags is provided.

A hinge 208 is provided at the bottom part of the main body 1A, and contributes to inclining the device. Describing with reference to FIG. 34, as described above, in the embodiment of FIG. 32 to FIG. 34, the number of the bags 4 which are held therein is comparatively small; therefore it is required to replenish or supplement the bags at an opportune moment. In this case, for example, first pull the handle 202 in the state illustrated in FIG. 33, and the main body 1A is rotated around the hinge 208 (FIG. 32) to be in the state illustrated in FIG. 34.

The way to replenish the bags 4, in the state of FIG. 34, is the same as in the embodiments of FIG. 1 to FIG. 31, so that the description is abbreviated. The way to receiving an umbrella which is not illustrated in the state illustrated in FIG. 33 is the same as described above, so that a repeated description is omitted.

In this way, by the embodiment in FIG. 32 to FIG. 34, the device can be installed without obstructing the way in narrow places such as passages (for example, the aisles of buses) in which the installment of the embodiments of FIG. 1 to FIG. 31 is difficult. The operation and so on are the same as those of the embodiments in FIG. 1 to FIG. 31.

It is added that the embodiments in the drawings are only examples, and are not intended to limit the technical scope of the present invention.

Effect

As described above, since the device for automatically receiving an umbrella in a bag of the present invention, wherein the receiving bags for receiving umbrellas are loaded within the main body of the device and the opening operation member for opening the insertion opening of the receiving bag is provided within the main body of the device so as to be rotatable, is arranged so as to open the insertion opening of the above-described receiving bag by operating the opening operation member by compressing it with the point of an umbrella, an umbrella can be automatically and easily received in the bag without using a motor and so on (prior arts), and so the device of the present invention has an effect of, for example, providing an extremely practical device which can be used where there is no electric power source, as well as, can reduce the manufacturing cost, without the possibilities that the electric cord will become a hindrance and that an electric leak will occur.

Further, when the umbrella which has been received in the bag is taken out of the device, the opening operation mechanism automatically returns to the state same as that of before the umbrella compresses the opening operation mechanism by the elasticity repulsion of the elasticity members such as a spring and so on; therefore the device can be used successively. In addition, when the opening operation mechanism returns to the state the same as that of before it is compressed by an umbrella, the opening operation mechanism is prevented from rolling up the unused receiving bag which faces the opening operation mechanism.

I claim:

1. A device for automatically receiving an umbrella and positioning said umbrella in a bag, comprising:

umbrella receiving bags which are loaded within a main body; and an opening operation member in said main body for rotating and opening an insertion opening of a selected one of said receiving bags when rotated by a point of said umbrella, wherein said opening operation member is supported for movement by a mobile plate for advancement to and retreat from said selected one of said umbrella receiving bags loaded within the main body and wherein said opening operation member has a four link mechanism including said mobil plate, a pair of parallel links, and a fixed plate.

2. A device for automatically receiving an umbrella and positioning said umbrella in a bag, comprising:

umbrella receiving bags which are loaded within a main body; and an opening operation member in said main body for rotating and opening an insertion opening of a receiving bag of a selected one of said receiving bags when rotated by a point of said umbrella, wherein said opening operation member includes a first member having a receiving part to which said point portion of said umbrella abuts, a second member supported by a shaft for rotation with said first member, said first member and said second member forming a spatula shape, and an elastic member attached where said first member and said second member are supported by said shaft and moves said second member upwards in a direction where the second member abuts to said receiving bag.

3. A device for automatically receiving an umbrella and positioning said umbrella in a bag, comprising:

umbrella receiving bags which are loaded within a main body; and an opening operation member in said main body for rotating and opening an insertion opening of a receiving bag of a selected one of said receiving bags when rotated by a point of said umbrella, wherein said opening operation member includes a fragmentary member for receiving a part to which said point of said umbrella abuts, opens said insertion opening of said receiving bag, and guides said point of said umbrella into said insertion opening, a first link positioned and inclined in a horizontal direction on a rotation shaft of said fragmentary member, a second link having a front end portion to which said first link is fixed and rotates within a vertical surface, a first elastic member for moving said fragmentary member in a direction in which said fragmentary member returns to its position before said fragmentary member rotated and before said fragmentary member rotated around said first link, and a second elastic member for moving said second link toward a side of said receiving bag.

* * * * *